US007878616B2

(12) United States Patent
Hiraoka

(10) Patent No.: US 7,878,616 B2
(45) Date of Patent: Feb. 1, 2011

(54) CAP AND DROPLET EJECTING APPARATUS

(75) Inventor: Eisuke Hiraoka, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 1034 days.

(21) Appl. No.: 11/447,354

(22) Filed: Jun. 6, 2006

(65) Prior Publication Data

US 2007/0146407 A1 Jun. 28, 2007

(30) Foreign Application Priority Data

Dec. 27, 2005 (JP) ..... 2005-375917
Dec. 27, 2005 (JP) ..... 2005-376229

(51) Int. Cl.
*B41J 29/393* (2006.01)
*B41J 29/38* (2006.01)

(52) U.S. Cl. ..... 347/19; 347/9

(58) Field of Classification Search ..... 347/9, 347/19

See application file for complete search history.

(56) References Cited

FOREIGN PATENT DOCUMENTS

| | | | |
|---|---|---|---|
| JP | 6-64180 | | 3/1994 |
| JP | 2000079696 A | * | 3/2000 |
| JP | 2000-255053 | | 9/2000 |
| JP | 2003-165203 | | 6/2003 |
| JP | 2004-243164 | | 9/2004 |
| JP | 2005271316 A | * | 10/2005 |

* cited by examiner

*Primary Examiner*—Matthew Luu
*Assistant Examiner*—Jannelle M Lebron
(74) *Attorney, Agent, or Firm*—Fildes & Outland, P.C.

(57) ABSTRACT

The present invention provides a droplet ejecting apparatus including an ejector that ejects a liquid, and a humidity regulator that includes a humidity regulating material and regulates humidity around the ejector. The invention also provides a cap for maintaining a droplet ejecting port in an airtight condition, the droplet ejecting port being for ejecting a droplet by an ink jet system, the cap including, at least in an inner wall, a humidity regulating material containing an inorganic porous material.

9 Claims, 23 Drawing Sheets

CAP AND DROPLET EJECTING APPARATUS

CROSS-REFERENCE TO RELATED APPLICATION

This application claims priority under 35 USC 119 from Japanese Patent Application Nos. 2005-375917 and 2005-376229, the disclosures of which are incorporated by reference herein.

BACKGROUND

1. Technical Field

The present invention relates to a droplet ejecting apparatus, and particularly to a droplet ejecting apparatus suppressing occurrence of nozzle clogging. The invention also relates to a cap to be provided at a liquid ejection port in an ink jet system and a droplet ejecting apparatus having the cap, and particularly to a cap and a droplet ejecting apparatus suppressing occurrence of clogging of a liquid ejection port due to drying.

2. Related Art

Ink jet systems for ejecting liquid from nozzles comprising nozzles, slits and porous film are used widely in various printers because of their small size and low price. Among ink jet systems, a piezo ink jet system for ejecting ink by making use of deformation of piezoelectric elements, and a thermal ink jet system for ejecting liquid by boiling a liquid using thermal energy are noted for excellent characteristics such as high resolution and high speed printing.

When the liquid is ink, generally, water-based inks containing mainly water as a solvent, and oil-based inks containing mainly an organic solvent as a solvent are known. Water, which is used as a solvent in a water-based ink, is high in vapor pressure, and thus is evaporated with the lapse of time, which is problematic since the coloring material in the ink then solidifies.

Ink jet systems can also be applied to formation of a circuit pattern or a color filter by ejecting curable resin. In this case, however, the viscosity of the liquid including the curable resin may be increased by drying, whereby problems may occur in ejection.

Thus, in the ink jet system, the ejection stability of an ink jet tends to be influenced by the external environment, and nozzle clogging may occur with the passage of time.

To overcome such problems, it has been proposed to dispose vapor generating means between feeding means and image forming means (see, for example, Japanese Patent Application Laid-Open (JP-A) No. 2000-255053). In this method, however, vapor generating means must be newly provided, and it is hard to control the humidity around the image forming means with the vapor generating means.

As another method of controlling the external environment around image forming means, for example, a method of applying liquid to a recording sheet before printing, and heating and drying the sheet at the time of printing to evaporate the liquid applied on the recording sheet, so that the humidity is increased near the head has been disclosed (see, for example, Japanese Patent Application Laid-Open No. 2003-165203).

In this method, however, since liquid is applied onto the recording sheet, the image quality is directly influenced, and nozzle clogging cannot be prevented unless printing is conducted frequently.

Another proposal is a method of using an atmosphere control box enclosing the atmosphere around the head, and sending gas adjusted in temperature and humidity into the atmosphere control box (see, for example, JP-A No. 2004-243164). In this method, the gas to be sent must be adjusted in temperature and humidity, adverse effects may be caused on ejection of the ink depending on the gas blowing direction, and the design of the apparatus is also difficult.

In the ink jet system, the ejection stability of droplets tends to be influenced by the external environment and, in particular, the nozzles tend to become clogged if not used for a long time in dry conditions.

To solve this problem, attempts have been made to cap the nozzle surface to shut off the outside air and suppress drying around the nozzles when not ejecting. However, when not used for a long time or when exposed to high temperature, drying of nozzles cannot be prevented sufficiently.

As the cap material, it has been proposed to use a moistened high water absorbing resin (see, for example, JP-A No. 6-64180). In this method, when dried, the high water absorbing resin gradually releases water, and it is thought that drying in the cap can thus be prevented.

However, high water absorbing resin absorbs water and is swollen, so that a cap made of the high water absorbing resin cannot be fixed to the jig, and when, on the other hand, the cap releases water and contracts, the airtightness of the cap is decreased.

Further, the cap must be moistened and then fixed before use.

As a method of preventing drying of nozzles, it has also been proposed to use a hydrophilic metal porous body for the cap (see, for example, JP-A No. 6-64180). In this method, a metal porous body having fine pores of tens to hundreds of μm suctions and holds ink by capillary action, so that drying in the cap is prevented.

In this method, however, a certain volume of ink must be suctioned by capillary action, so that it is necessary to install a container holding the ink, and connect the container to the end of the cap formed of the metal porous body. As a result, the cap structure is complicated, and at least the connecting portion to the container holding the moisture and a part of the cap must be formed of the metal porous body.

SUMMARY

According to an aspect of the invention, there is provided a droplet ejecting apparatus comprising an ejector that ejects a liquid, and a humidity regulator that comprises a humidity regulating material and regulates humidity around the ejector.

BRIEF DESCRIPTION OF THE DRAWINGS

Embodiments of the present invention will be described in detail based on the following figures.

FIG. 3A shows an example of disposition of moisture adjusting material, and FIG. 3B shows another example of disposition of moisture adjusting material.

FIG. 4A shows a case where the pores are appropriately small, and FIG. 4B shows a case where the pores are large.

FIG. 5A is a view showing a case where a wall member 19 encloses the nozzle surface, and FIG. 5B is a view showing a case where a brush 20 is further provided at the end of the wall member 19.

FIG. 6A shows a case where a housing 21 is provided, and FIG. 6B shows a case where a brush 20 is further provided at the end of the housing 21.

FIG. 10A shows an example of disposition of moisture adjusting material, FIG. 10B shows another example of disposition of moisture adjusting material, and FIG. 10C shows still another example of disposition of moisture adjusting material.

FIG. 11A is a view showing a case where a wall member 19 encloses the nozzle surface, and FIG. 11B is a view showing a case where a brush 20 is further provided at the end of the wall member 19.

FIG. 12A shows a case where a housing 21 is provided, and FIG. 12B shows a case where a brush 20 is further provided at the end of the housing 21.

FIG. 14A shows a case where a connection port is provided at a position opposite to the nozzle 17 (17*a* to 17*e*), and FIG. 14B shows a case where a connection port is provided to the housing 21.

FIG. 19A is a perspective view, FIG. 19B is a sectional view, and FIG. 19C is a sectional view showing an example of another configuration.

DETAILED DESCRIPTION

Figure 1:
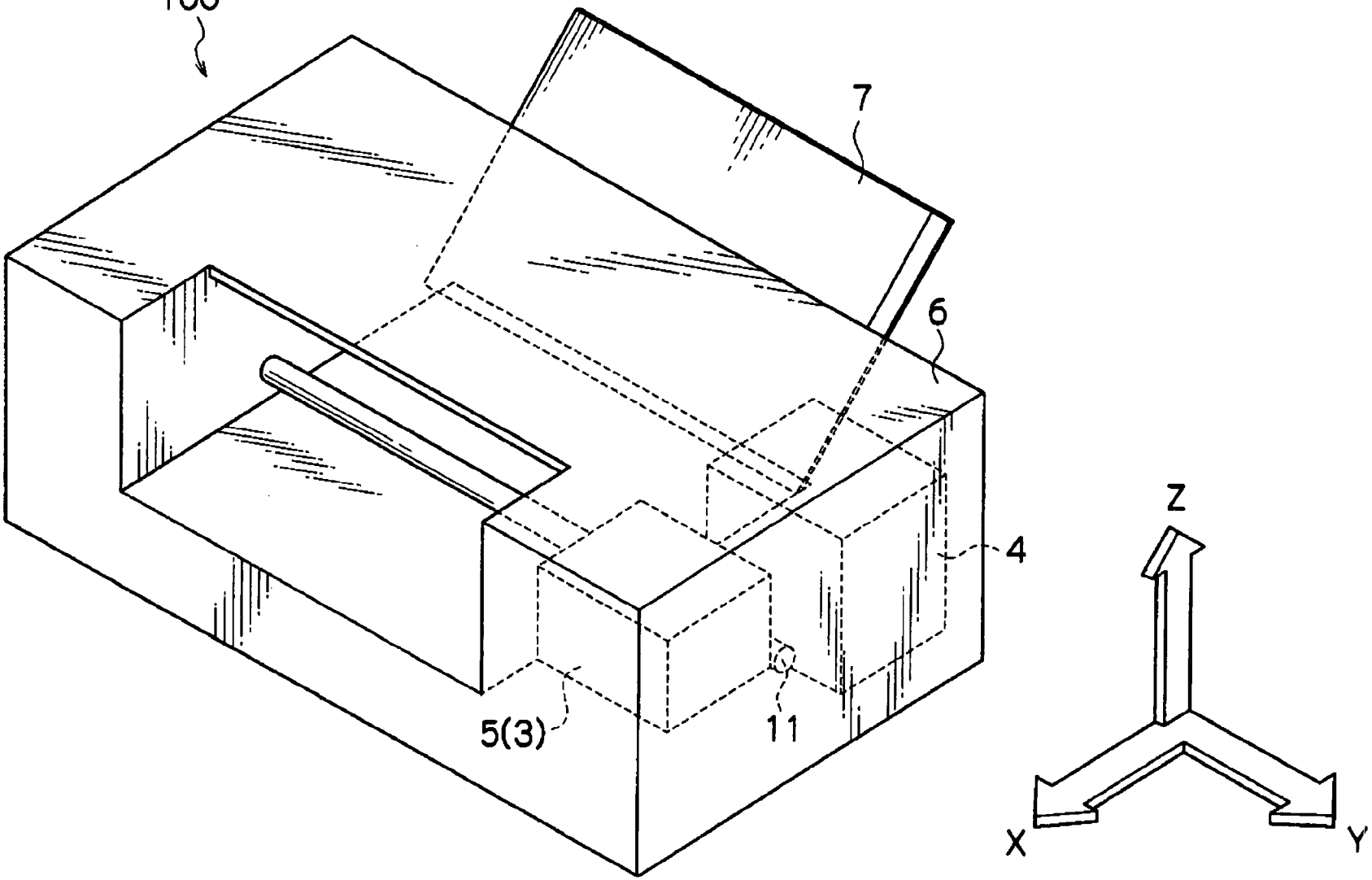
FIG. 1 is a perspective view showing an external appearance of an ink jet recording apparatus in a first embodiment.

A droplet ejecting apparatus in a first aspect of the present invention includes an ejector that ejects a liquid, and a humidity regulator that regulates the humidity near the ejector by using a humidity regulating material. The droplet ejecting apparatus may be an ink jet recording apparatus using ink as the liquid, or may be a forming apparatus that forms a resin product by ejecting a liquid containing resin.

Exemplary embodiments of the droplet ejecting apparatus in the first aspect of the invention are described below while referring to the accompanying drawings, and the first embodiment to the ninth embodiment refer to the ink jet recording apparatus using ink as the liquid.

Members having substantially the same functions have the same reference numerals and duplicate explanations are omitted.

Recording Apparatus of the First Embodiment

Figure 2:
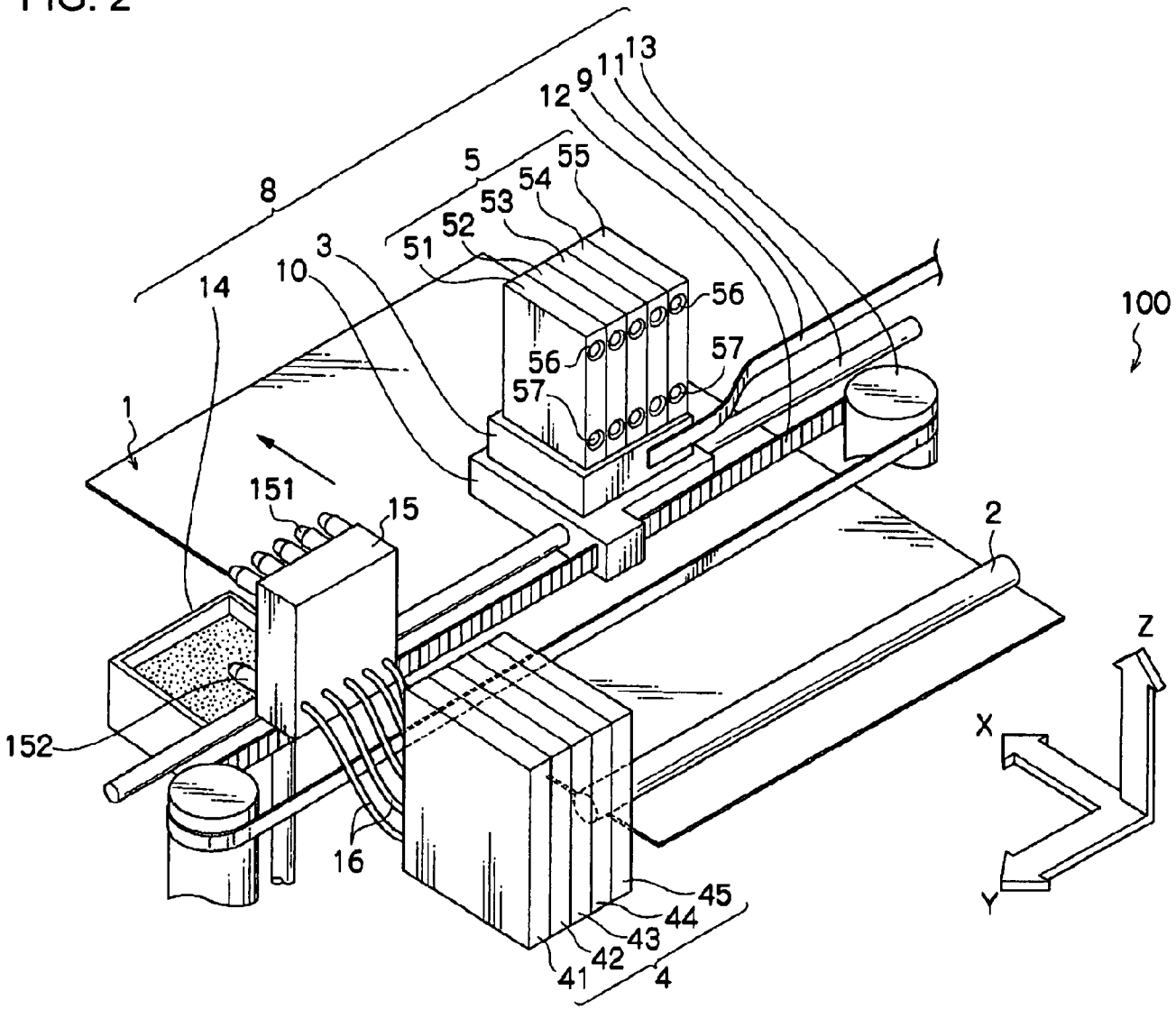
FIG. 2 is a perspective view showing an internal basic structure of the ink jet recording apparatus in FIG. 1.
Figure 3A:
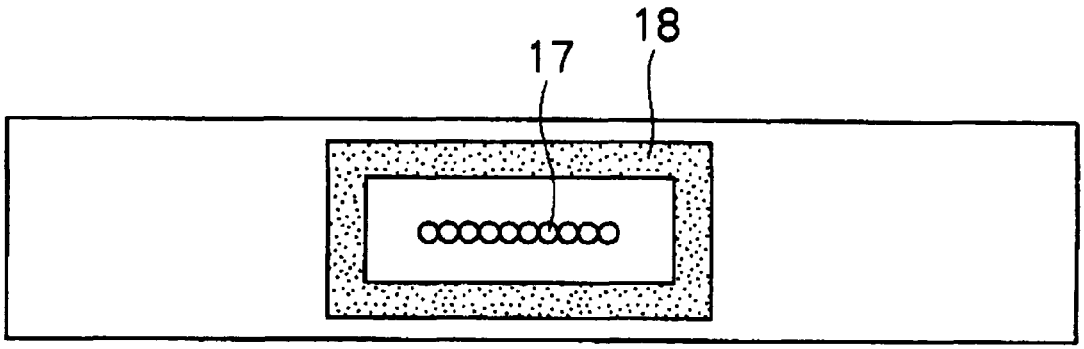
FIGS. 3A and 3B are schematic views showing a structure at the nozzle surface side of the recording head 3 in FIG. 2.
Figure 3B:
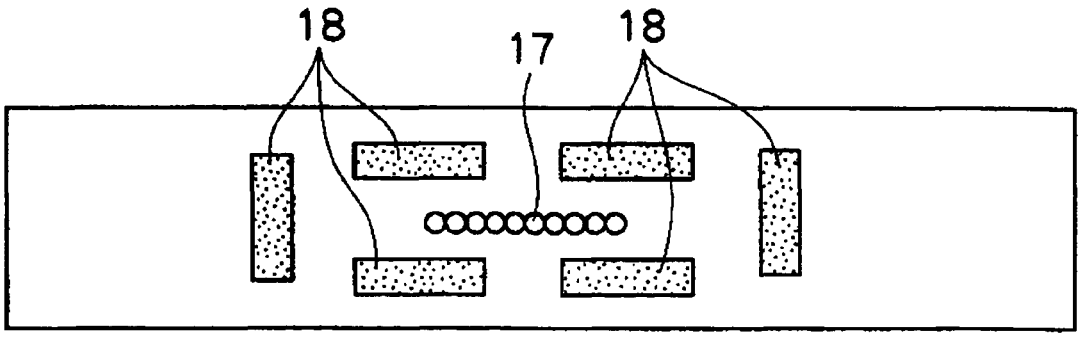

FIG. 1 is a perspective view showing an external appearance of an exemplary embodiment of an ink jet recording apparatus in the first embodiment. FIG. 2 is a perspective view showing an internal basic structure of the ink jet recording apparatus (hereinafter called "recording apparatus") in FIG. 1. FIG. 3A and FIG. 3B are schematic views showing a structure at the nozzle surface side of the recording head 3 in this embodiment.

Referring first to FIG. 1 and FIG. 2, the configuration of the recording apparatus and its ejecting operation are described.

The recording apparatus 100 of the embodiment mainly includes, as shown in FIG. 1 and FIG. 2, an outer cover 6, a tray 7 for stacking up a specified number of sheets of a recording medium 1 such as plain paper, a conveying roller (conveying device) 2 for conveying the recording medium 1 one by one into the recording apparatus 100, an image forming unit 8 (image forming device) for forming an image by ejecting ink and liquid composition on the surface of the recording medium 1, and a main ink tank 4 for replenishing a sub ink tank 5 with ink and processing liquid.

The conveying roller 2 is a paper feed mechanism composed of a pair of rollers disposed rotatably in the recording apparatus 100, and holds the recording medium 1 mounted on the tray 7, and conveys a specified amount of the recording medium 1 into the apparatus 100 one by one at specified timing.

The image forming unit 8 forms an ink image on the surface of the recording medium 1. The image forming unit 8 is mainly composed of a recording head 3, sub ink tank 5, power feed signal cable 9, carriage 10, guide rod 11, timing belt 12, drive pulley 13, and maintenance unit 14.

The sub ink tank 5 has ink tanks 51, 52, 53, 54 and 55 containing inks of different colors or liquid compositions as available for ejection. For example, as inks for ink jet, black ink (K), yellow ink (Y), magenta ink (M), cyan ink (C), and processing liquid are contained. If processing liquid is not used, or if processing liquid contains color material, an ink tank for processing liquid is not needed.

The sub ink tank 5 has exhaust holes 56 and refill holes 57. When the recording head 3 moves to a waiting position (or a refill position), exhaust pins 151 and refill pins 152 of an replenishing device 15 are inserted into the exhaust holes 56 and refill holes 57, and thus the sub ink tank 5 and replenishing device 15 connect with each other. The replenishing device 15 is connected to the main ink tank 4 through refill tubes 16, and the inks and processing liquid are supplied from the main ink tank 4 into the sub ink tank 5 through the refill tubes 57 by means of the replenishing device 15.

The main ink tank 4 also has main ink tanks 41, 42, 43, 44, and 45 containing inks of different colors and processing liquid. For example, as the first liquids, black ink (K), yellow ink (Y), magenta ink (M), cyan ink (C) are contained, and as the second liquid, a processing liquid is contained, and these tanks are detachably installed in the recording apparatus 100.

Further, as shown in FIG. 2, the power feed signal cable 9 and sub ink tank 5 are connected to the recording head 3, and when external image recording information is entered in the recording head 3 through the power feed signal cable 9, the recording head 3 sucks a specified amount of ink from each ink tank on the basis of this image recording information, and ejects the ink on the surface of a recording medium. The power feed signal cable 9 also plays a role of feeding electric power necessary for driving the recording head 3 into the recording head 3, aside from the image recording information.

The recording head 3 is disposed and held on a carriage 10, and a guide rod 11 and a timing belt 12 connected to drive pulleys 13 are connected to the carriage 10. Owing to this configuration, the recording head 3 can move, along the guide rod 11, in the direction Y (main scanning direction) that is vertical to the conveying direction X (sub scanning direction) of the recording medium 1 and is parallel to the surface of the recording medium 1.

The recording apparatus 100 includes controller (not shown) that controls the driving timing of the recording head 3 and the driving timing of the carriage 10 on the basis of image recording information. Accordingly, along the conveying direction X, an image can be continuously formed according to the image recording information in a specified area of the surface of the recording medium 1 conveyed at specified speed.

The recording head 3 of the embodiment also has nozzles 17 as ink eject ports (ejector, see FIG. 3A and FIG. 3B), liquid passages, an energy applying section (not shown) provided at a part of the liquid passages, and energy generator (not shown) that generates droplet forming energy to be applied to the ink existing in the energy applying section.

Examples of the energy generator includes, for example, a piezo ink jet recording system using an electrodynamic transducer, a recording system of using an energy generator for ejecting droplets by a thermal action by emitting laser or electromagnetic waves to generate heat, and a thermal ink jet recording system of ejecting liquid by heating the liquid by an electrothermal transducer such as exothermic elements having a heating resistance.

From the viewpoint of improvement of bleeding and intercolor bleeding, the ink jet recording apparatus of the embodiment may use a thermal ink jet recording system or piezo ink jet recording system. The reason is not clear, but in the case of the thermal ink jet recording system, the ink is heated and the viscosity thereof is lowered at the time of ejection, and since the ink temperature is lowered on the recording medium, the viscosity increases suddenly. It is therefore considered that bleeding and intercolor bleeding are improved. In the case of a piezo ink jet system, on the other hand, liquid of high viscosity can be ejected, and the liquid of high viscosity can suppress spreading in the paper surface direction on the recording medium, and it is therefore considered that bleeding and intercolor bleeding are improved.

The maintenance unit 14 is connected to a pressure reducing device (not shown) through a tube. This maintenance unit 14 is connected to the nozzle portion of the recording head 3, and the pressure in the nozzles of the recording head 3 is reduced, so that the ink can be sucked off from the nozzles of the recording head 3. By this maintenance unit 14, as required, extra ink sticked to the nozzles 17 can be removed during operation of the recording apparatus 100, or evaporation of ink from the nozzles can be suppressed while the operation is stopped.

The humidity regulator is explained with reference to FIGS. 3A and 3B showing the recording head 3 in FIG. 2 as observed from the side of the nozzle surface (droplet ejecting surface).

The recording head 3 has nozzles 17, and ink is ejected from the nozzles 17. In FIG. 3A and FIG. 3B, nozzles 17 are arranged linearly in one row, but the layout of nozzles 17 is not limited, and for example, plural rows of nozzles 17 may be disposed in parallel and the nozzles 17 of each row may be shifted by a half pitch, so that the density of droplets formed on the recording medium 1 may be enhanced.

In this embodiment, as the humidity regulator, a humidity regulating material is disposed near the nozzles 17 (ejector), whereby the humidity around the ejector is regulated. Location of the humidity regulating material is not particularly limited. For example, as shown in FIG. 3A, a humidity regulating material 18 may be disposed on the nozzle surface (droplet ejecting surface) so as to surround the linearly disposed nozzles 17, or as shown in FIG. 3B, humidity regulating material 18 may be disposed at intervals near the nozzles 17 of the nozzle surface (droplet ejecting surface).

In the invention, the humidity regulating material is any material capable of regulating the humidity, and for example, a material that absorbs moisture from air until a specific humidity is reached, and releases the absorbed moisture when the humidity becomes lower than a specific humidity, that is, a material that absorbs and releases moisture depending on the humidity. Examples of the humidity regulating material include an inorganic porous material and high molecular humidity regulating material.

In the inorganic porous material, the average pore radius may be 0.5 to 40 nm, 1.5 to 15 nm, or 2.0 to 5.0 nm. When the pore radius is in this range, moisture in the air is held in the pores when the humidity becomes more than an appropriate humidity, and the held moisture is released when becoming lower than the appropriate humidity, so that the humidity can be always constant.

Figure 4B:
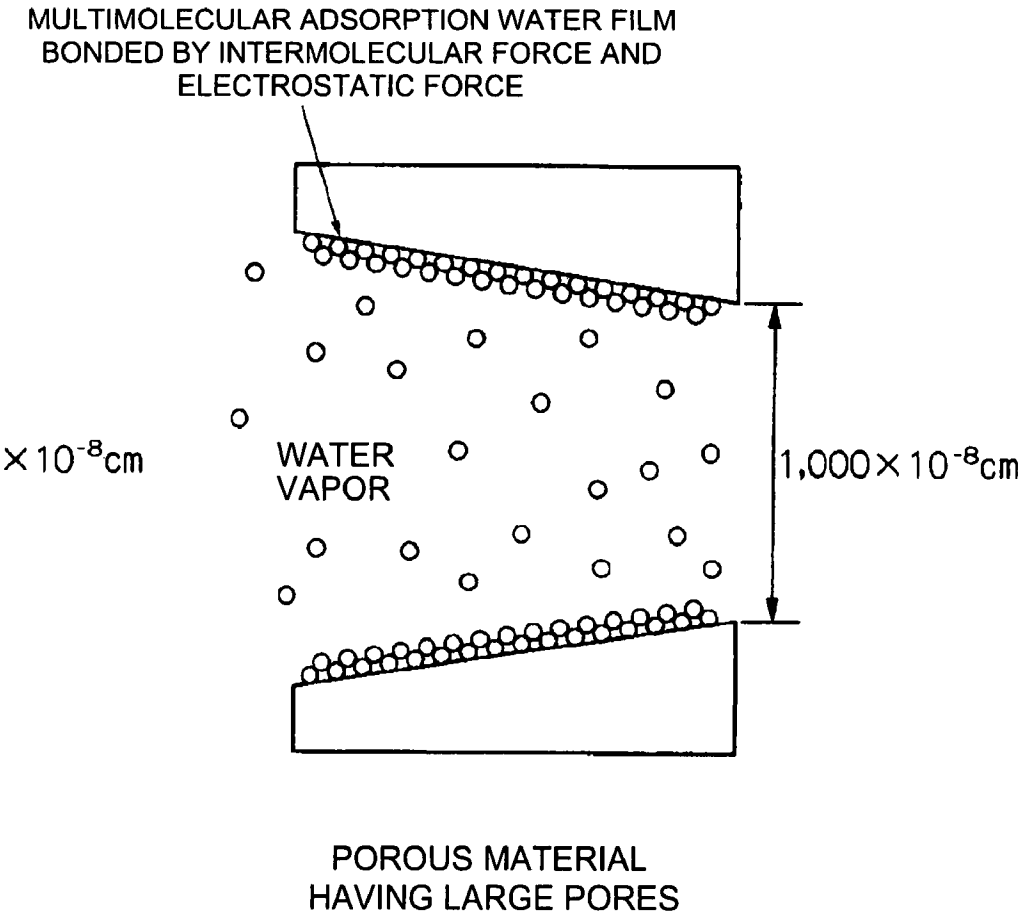
FIGS. 4A and 4B are explanatory views of porous material adsorbing water.
Figure 4A:
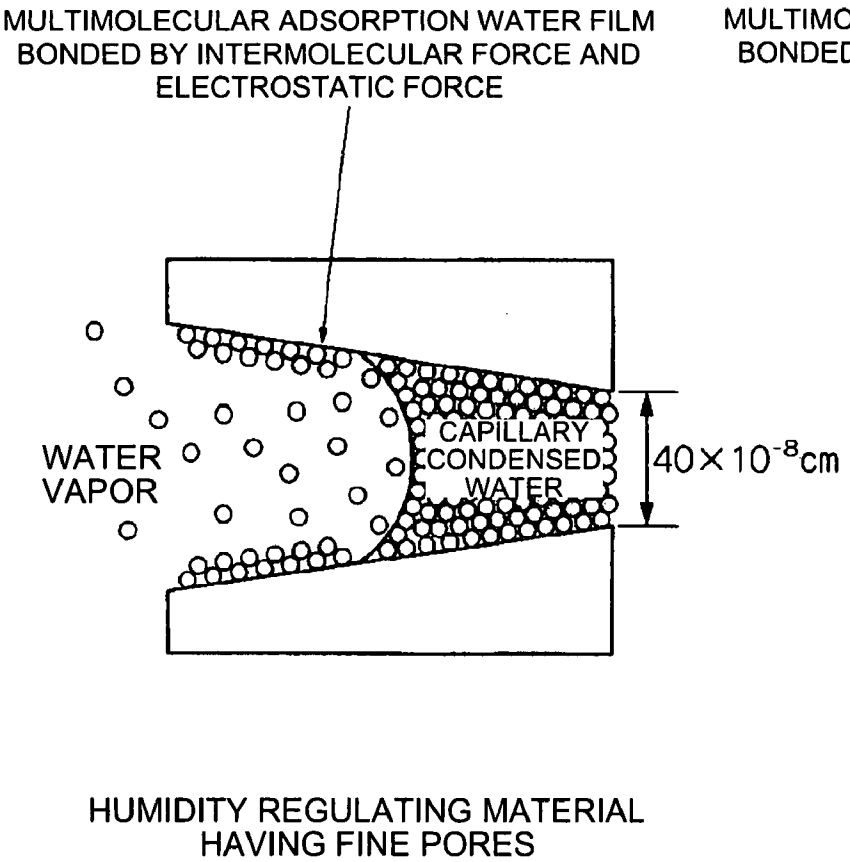

Referring now to FIG. 4A and FIG. 4B, adsorption of water vapor in a porous material is explained.

As shown in FIG. 4B, in a porous material having large pores of an average diameter of about $1000\times10^{-8}$ cm, multimolecular adsorption water film that is bonded by intermolecular force and electrostatic force is formed on the surface of the pore, but since the pore size is large, most of the water vapor cannot be captured.

However, as shown in FIG. 4A, in the case of a porous material of a pore radius of about 0.5 to 40 nm, in addition to the multimolecular adsorption water film formed on the surface of the pore, capillary condensed water is attached between the multimolecular adsorption water films, so that the water vapor is captured effectively.

Supposing that the attaching of this capillary condensed water is caused by condensation on capillary pores, Kelvin equation expressed by the following equation (1) is established between the vapor pressure and the pore radius.

$$InP/P_0=-2\gamma V_L\cos\theta/rRT \qquad \text{Equation (1)}$$

In equation (1), P is a partial pressure of water vapor, $P_0$ is a saturated water vapor pressure, $\gamma$ is a surface tension of liquid, $V_L$ is a molecular volume of liquid, θ is a contact angle, r is a pore radius, R is the gas constant, and T is an absolute temperature.

Table 1 below shows the relation between the pore radius r (Å) and the humidity (RH %) when capillary condensation is completed at 20° C. (source: Mechanism of humidity regulation, Knowledge of Architecture, September 1998).

TABLE 1

| RH(%) | r(Å) | RH(%) | r(Å) |
|---|---|---|---|
| 100 | ∞ | 70 | 31 |
| 98 | 550 | 60 | 22 |
| 95 | 217 | 50 | 16 |
| 90 | 105 | 40 | 12 |
| 80 | 50 | 30 | 9 |

As shown in Table 1, in the case of a porous material having a pore radius of, for example, 50 Å (5 nm), when the humidity is 80 RH %, capillary condensation is completed, and capillary condensed water is filled between the multimolecular adsorption water films. That is, in the porous material having a pore radius of 50 Å (5 nm), at a humidity lower than 80 RH %, multimolecular adsorption water film is formed, and then capillary condensation among particles occurs at a humidity of around 80 RH %, whereby liquid crosslink is formed and the water vapor attaching amount increases. Therefore, at a humidity of 80 RH % or more, water vapor in air is adsorbed, but at a humidity of less than 80 RH %, the adsorbed water vapor is released depending on the partial pressure of water vapor.

On the other hand, in the case of large pore size, adsorption in pores and capillary condensation are completed at considerably high humidity, and only multimolecular adsorption water film is formed on the pore surface. Hence, liquid crosslink is not formed in most part, and increase in the amount of attached water vapor is not recognized.

As shown from Table 1, in order to obtain a humidity regulating effect by making use of water vapor adsorbed by capillary condensation, practically, an inorganic porous material having a pore radius of 0.5 to 40 nm, 1.5 nm (humidity: about 40 RH %) to 15 nm (humidity: about 92 RH %), or 2.0 nm (humidity: about 60 RH %) to 5 nm (humidity: about 80 RH %) may be used.

The inorganic porous material is not particularly limited as far as the pore size satisfies the above range, and examples thereof include, for example, charcoal, bamboo coal, active carbon, diatom earth, zeolite type compounds such as alumina silicate and alumina phosphate, zeolite type compounds partly replaced by metal, noncrystalline silica alumina gel, allophane, imogorite, kaolin, kanemite, clay minerals, and those artificially zeolitized. They may be used either directly, or used after molding by using pulp, resin, lime, gypsum, cement, or the like.

Examples of the high molecular humidity regulating material include those obtained from the combination of a water absorbing high polymer containing a polyacrylate or a polyacrylate-polyvinyl alcohol copolymer, and a water soluble high polymer containing polyvinyl alcohol or polyisopropyl acrylamide. The high molecular humidity regulating material disclosed in JP-A No. 2005-270958 may be particularly effective.

The surface of the inorganic porous material may be coated with humidity regulating film containing a high molecular polymer or the like. Examples of such a high molecular polymer include polyethylene glycol, those having —OH group, —COOH, —N<(—$NH_2$, —NHϕ, Nϕ), >CO, —O—, or other groups in the molecular structure, fatty acid salt, glycerin fatty acid, sorbitan fatty acid, sucrose fatty acid, carboxy methyl cellulose, polyvinyl alcohol, polyallylamine, water soluble cellulose acetate, natural high molecular polymer, starch-polyacrylonitrile hydrolyte, starch-polyacrylate crosslinked product, saponification product of vinyl acetate-methyl acrylate copolymer, and sodium polyacrylate crosslinked product.

By coating with such humidity regulating film, the humidity regulating capacity becomes higher than that of the inorganic porous material without the film, so that the amount of moisture being absorbed and released is increased.

As an example of the humidity regulating material, RHC humidity regulating material wherein the surface of charcoal is coated with humidity regulating film (manufactured by Highwood Co.) is explained. RHC humidity regulating material absorbs moisture when the ambient humidity exceeds 80%, and suddenly releases the absorbed moisture when the humidity becomes 80% or less. As compared with charcoal products, the humidity control capacity is more than 10 times.

By providing such a humidity regulating material 18 near the nozzles 17, the humidity around the nozzles 17 is kept constant, and clogging of nozzles 17 due to drying of ambient air can be prevented.

Figure 5A:
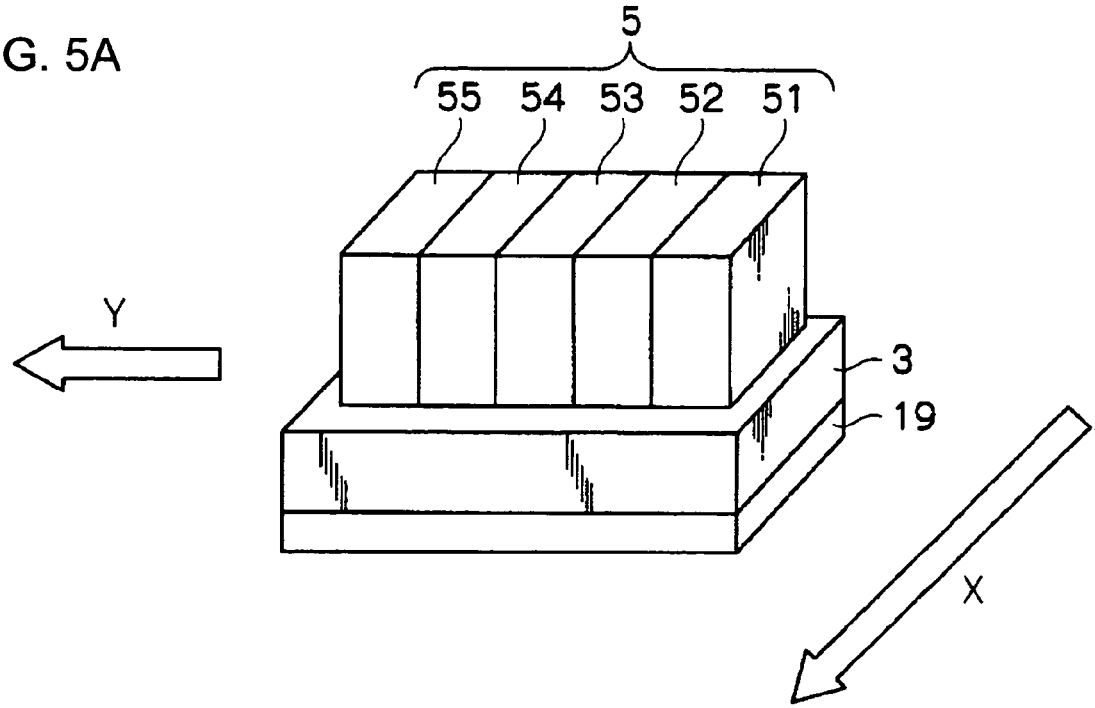
FIGS. 5A and 5B are enlarged perspective views of the surroundings of the recording head 3 in FIG. 2.
Figure 5B:
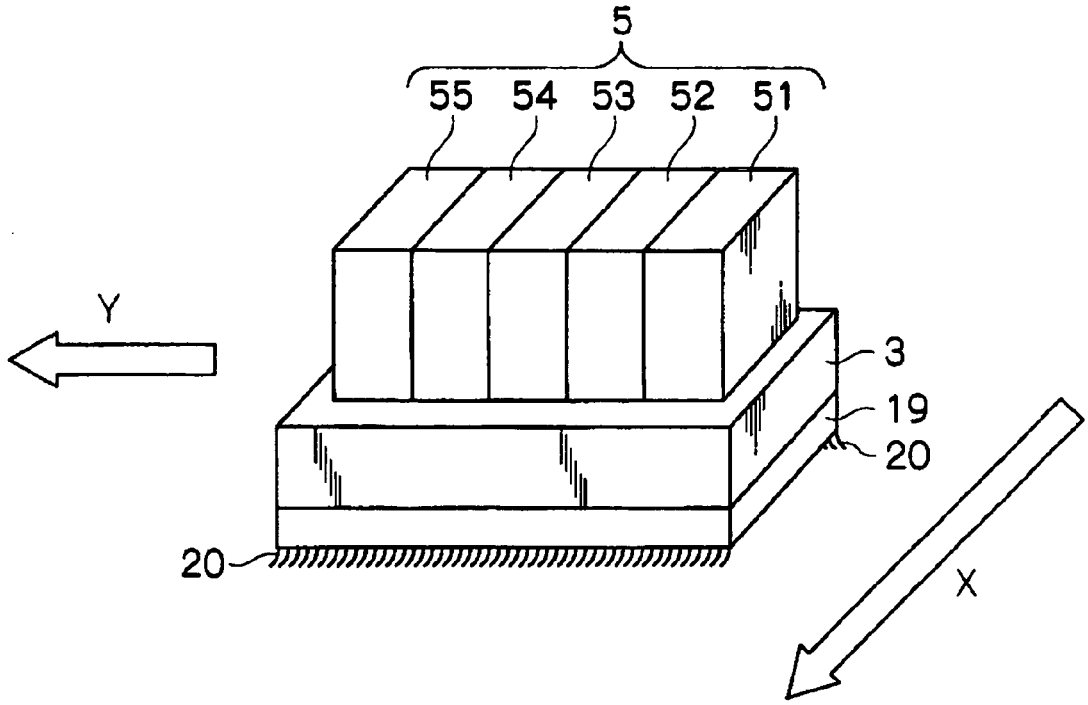

FIG. 5A and FIG. 5B are enlarged perspective views of the surroundings of the recording head 3. In order to further enhance the humidity regulating effect by the humidity regulating material 18 disposed near the nozzles 17, an enclosure member, such as a wall member 19 extended from the recording head 3 as shown in FIG. 5A, may be disposed so as to enclose the nozzle surface. When disposing the wall member 19, the wall member 19 is disposed so as to allow the recording medium 1 to pass.

The humidity regulating material 18 is provided at at least a part of the inner wall of the wall member 19. When the humidity regulating material 18 is provided at at least a part of the inner wall, the entire inner wall of the wall member 19 may be covered with the humidity regulating material 18, or the humidity regulating material 18 may be adhered to the inner wall at intervals. Further, the wall member 19 may be formed of the humidity regulating material 18. When the humidity regulating material 18 is disposed on the nozzle surface, as shown in FIGS. 3A and 3B, the humidity regulating material 18 may not be provided at the wall member 19.

Moreover, to enhance the humidity regulating effect, as shown in FIG. 5B, a brush 20 contacting with the recording medium 1 may be provided at the end of the wall member 19 so as not to disturb conveying of the recording medium 1.

The ink and processing liquid (recording liquids) to be contained in the sub ink tank 5 in the invention are described below.

The ink to be ejected from the nozzles of the recording head contains, at least, color material, water soluble solvent, and water. The processing liquid for aggregating the color material in the ink contains at least aggregating agent. Processing liquid containing color material may be used as ink (for example, yellow ink).

The color material may be either dye or pigment, and pigment may be used. As compared with dye, pigment may tend to aggregate when mixing with a second liquid. Among pigments, pigment dispersed by high molecular dispersant, self-dispersing pigment, and pigment coated with resin may be used.

Both organic pigment and inorganic pigment can be used as a pigment, and examples of black pigments include carbon black pigments such as furnace black, lamp black, acetylene black, and channel black. Pigments of black and three primary colors of cyan, magenta and yellow, specific color pigments of red, green, blue, brown and white, metallic gloss pigments such as gold and silver, colorless or pale fillers, plastic pigments, etc. may be used. Particles obtained by fixing dye or pigment on the surface of cores of silica, alumina or polymer beads, insoluble lake products of dye, colored emulsion, colored latex, and others may also be used as pigments. Further, pigments newly synthesized for the invention may be used.

Specific examples of pigment include Raven 7000, Raven 5750, Raven 5250, Raven 5000 ULTRAII, Raven 3500, Raven 2000, Raven 1500, Raven 1250, Raven 1200, Raven 1190 ULTRAII, Raven 1170, Raven 1255, Raven 1080, and 1060 (all manufactured by Colombian Carbon Corporation), Regal 400R, Regal 330R, Regal 660R, Mogul L, Black Pearls L, Monarch 700, Monarch 800, Monarch 880, Monarch 900, Monarch 1000, Monarch 1100, Monarch 1300, and Monarch 1400 (all manufactured by Cabot Corporation), Color Black FW1, Color Black FW2, Color Black FW2V, Color Black 18, Color Black FW200, Color Black S150, Color Black S160, Color Black S170, Printex 35, Printex U, Printex V, Printex 140U, Printex 140V, Special Black 6, Special Black 5, Special Black 4A, and Special Black 4 (all manufactured by Degussa), No. 25, No. 33, No. 40, No. 47, No. 52, No. 900, No. 2300, MCF-88, MA 600, MA 7, MA8, and MA 100 (all manufacture by Mitsubishi Chemical), and others.

Examples of the cyan color include C.I. Pigment Blue-1, -2, -3, -15, -15:1, -15:2, -15:3, -15:4, -16, -22, -60, and others.

Examples of the magenta color include C.I. Pigment Red-5, -7, -12, -48, -48:1, -57, -112, -122, -123, -146, -168, -184, -202, and others.

Examples of the yellow color include C.I. Pigment Yellow-1, -2, -3, -12, -13, -14, -16, -17, -73, -74, -75, -83, -93, -95, -97, -98, -114, -128, -129, -138, -151, -154, -155, -155, -180, and others.

The pigment self-dispersible in water used in the invention is a pigment having many groups soluble in water on the pigment surface and dispersing stably in water in the absence of high molecular dispersant. Specific examples thereof include pigments self-dispersible in water obtained by surface modification treatment of ordinary pigments by acid-base treatment, coupling agent treatment, polymer graft treatment, plasma treatment, oxidation/reduction treatment, or others.

Examples of the pigment self-dispersible in water also include, aside from the pigments by surface modification treatment, commercially available self-dispersible pigments such as Cab-o-jet-200, Cab-o-jet-250, Cab-o-jet-260, Cab-o-jet-270, Cab-o-jet-300, IJX-444 and IJX-55 manufactured by Cabot Corporation, and Microjet Black CW-1 and CW-2 manufactured by Orient Chemical Corporation.

The color material that is self-dispersible pigment may be a color material having a carboxylic acid group as a functional group on its surface. It is thought that since the carboxylic acid is small in degree of dissociation, dissociation of carboxylic acid can be suppressed by organic acid of which acid dissociation constant pKa is 4.5 or less, and hence aggregation is promoted.

When the color material has a sulfonic acid group on its surface, aside from the color material, a high molecular compound having a carboxylic acid group (resin having a carboxylic acid group) may be added. The color material having a sulfonic acid group on its surface is hard to aggregate, and thus optical density, bleeding and intercolor bleeding may not be improved. On the other hand, when a high molecular compound having a carboxylic acid group is added, at the time of mixing the two liquids, the high molecular compound becomes insoluble. It is thought that, at this time, the pigment is taken into the high molecular compound and is aggregated, so that optical density, bleeding and intercolor bleeding are improved.

Further, as the color material, a pigment coated with resin may also be used. This is called microcapsule pigment, and commercially available microcapsule pigments such as those manufactured by Dainippon Ink Co. and Toyo Ink Co. can be used, or microcapsule pigments manufactured for the invention can also be used.

The dye to be used in the invention may be either water-soluble dye or disperse dye. Specific examples of the water-soluble dye include C.I. Direct Black-2, -4, -9, -11, -17, -19, -22, -32, -80, -151, -154, -168, -171, -194, -195, C.I. Direct Blue-1, -2, -6, -8, -22, -34, -70, -71, -76, -78, -86, -112, -142, -165, -199, -200, -201, -202, -203, -207, -218, -236, -287, -307, C.I. Direct Red-1, -2, -4, -8, -9, -11, -13, -15, -20, -28, -31, -33, -37, -39, -51, -59, -62, -63, -73, -75, -80, -81, -83, -87, -90, -94, -95, -99, -101, -110, -189, -227, C.I. Direct Yellow-1, -2, -4, -8, -11, -12, -26, -27, -28, -33, -34, -41, -44, -48, -58, -86, -87, -88, -132, -135, -142, -144, -173, C.I. Food Black-1, -2, C.I. Acid Black-1, -2, -7, -16, -24, -26, -28, -31, -48, -52, -63, -107, -112, -118, -119, -121, -156, -172, -194, -208, C.I. Acid Blue-1, -7, -9, -15, -22, -23, -27, -29, -40, -43, -55, -59, -62, -78, -80, -81, -83, -90, -102, -104, -111, -185, -249, -254, C.I. Acid Red-1, -4, 8 -13, -14, -15, -18, -21, -26, -35, -37, -52, -110, -144, -180, -249, -257, -289, and C.I. Acid Yellow-1, -3, -4, -7, -11, -12, -13, -14, -18, -19, -23, -25, -34, -38, -41, -42, -44, -53, -55, -61, -71, -76, -78, -79, -122.

Specific examples of the disperse dye include C.I. Disperse Yellow-3, -5, -7, -8, -42, -54, -64, -79, -82, -83, -93, -100, -119, -122, -126, -160, -184:1, -186, -198, -204, -224, C.I. Disperse Orange-13, -29, -31:1, -33, -49, -54, -66, -73, -119, -163, C.I. Disperse Red-1, -4, -11, -17, -19, -54, -60, -72, -73, -86, -92, -93, -126, -127, -135, -145, -154, -164, -167:1, -177, -181, -207, -239, -240, -258, -278, -283, -311, -343, -348, -356, -362, C.I. Disperse Violet-33, C.I. Disperse Blue-14, -26, -56, -60, -73, -87, -128, -143, -154, -165, -165:1, -176, -183, -185, -201, -214, -224, -257, -287, -354, -365, -368, and C.I. Disperse Green-6:1, -9.

The color material to be used in the invention may be used in an amount of 0.1 to 20 mass % or 1 to 10 mass % of the total mass of the ink. If the content of the color material in the liquid is less than 0.1 mass %, sufficient optical density may not be obtained, or if the content of the color material is more than 20 mass %, the liquid ejection characteristic may be unstable.

The ink may also contain a high molecular dispersant in order to disperse the pigment. Or if the pigment self-dispersible in water is used, a high molecular dispersant may also be used. In the invention, high molecular substances added to disperse the dye (pigment) are called high molecular dispersant.

Examples of the high molecular substance to be used include a water-soluble high molecular substance, emulsion, and water-insoluble high molecular substances such as self-dispersible particles, and also includes a nonionic compound, anionic compound, cationic compound, and amphoteric compound. For example, copolymers of monomers having an α, β-ethylenic unsaturated group may be used.

Specific examples of the monomers having an α,β-ethylenic unsaturated group include acrylic acid, methacrylic acid, crotonic acid, itaconic acid, monoesters of itaconic acid, maleic acid, monoesters of maleic acid, fumaric acid, monoesters of fumaric acid, vinyl sulfonic acid, styrene sulfonic acid, sulfonated vinyl naphthalene, vinyl alcohol, acrylamide, methacryloxy ethyl phosphate, bis-methacryloxy ethyl phosphate, methacryloxy ethyl phenyl acid phosphate, ethylene glycol dimethacrylate, diethylene glycol dimethacrylate, styrene, α-methyl styrene, vinyl toluene, other styrene derivatives, vinyl cyclohexane, vinyl naphthalene, vinyl naphthalene derivatives, alkyl acrylate, phenyl acrylate, alkyl mathacrylate, phenyl methacrylate, cycloalkyl methacrylate, alkyl crotonate, dialkyl itaconate, and dialkyl maleate.

A copolymer obtained by copolymerization of one or plural monomers having an α, β-ethylenic unsaturated group is used as the high molecular dispersant. Specific examples thereof include polyvinyl alcohol, polyvinyl pyrrolidone, styrene-styrene sulfonic acid copolymer, styrene-maleic acid copolymer, styrene-methacrylic acid copolymer, styrene-acrylic acid copolymer, vinyl naphthalene-maleic acid copolymer, vinyl naphthalene-methacrylic acid copolymer, vinyl naphthalene-acrylic acid copolymer, alkyl acrylate-acrylic acid copolymer, alkyl methacrylate-methacrylic acid copolymer, styrene-alkyl methacrylate-methacrylic acid copolymer, styrene-alkyl acrylate-acrylic acid copolymer, styrene-phenyl methacrylate-methacrylic acid copolymer, and styrene-cyclohexyl methacrylate-methacrylic acid copolymer.

The high molecular dispersant may be contained in a range of 0.1 to 3 mass % in the ink. If the content is more than 3 mass %, the ink viscosity may be too high, and ink ejection characteristic may be unstable. If the content is less than 0.1 mass %, the dispersion stability of the pigment may be lowered. The content of the high molecular dispersant may be 0.15 to 2.5 mass %, or 0.2 to 2 mass %.

Examples of the water-soluble organic solvents contained in the ink include polyhydric alcohols, polyhydric alcohol derivatives, solvents containing nitrogen, alcohols, and solvents containing sulfur. Specific examples of the polyhydric alcohols include ethylene glycol, diethylene glycol, propylene glycol, butylene glycol, triethylene glycol, 1,5-pentane diol, 1,2,6-hexane triol, and glycerin. Specific examples of the polyhydric alcohol derivatives include ethylene glycol monomethyl ether, ethylene glycol monoethyl ether, ethylene glycol monobutyl ether, diethylene glycol monomethyl ether, diethylene glycol monoethyl ether, diethylene glycol monobutylether, propylene glycol monobutyl ether, dipropylene glycol monobutyl ether, and ethylene oxide adduct of diglycerin. Specific examples of the solvents containing nitrogen include pyrrolidone, N-methyl-2-pyrrolidone, cyclohexyl pyrrolidone, and triethanol amine. Examples of the alcohols include ethanol, isopropyl alcohol, butyl alcohol, and benzyl alcohol. Examples of the solvents containing sulfur include thiodiethanol, thiodiglycerol, sulforane, and dimethyl sulfoxide. Besides, propylene carbonate and ethylene carbonate may also be used.

At least one or more of the water-soluble organic solvents may be used. The content of the water-soluble organic solvents may be 1 to 60 mass %, or 5 to 40 mass %. If the content of the water-soluble organic solvents in the ink is less than 1 mass %, sufficient optical density may not be obtained, or if the content is more than 60 mass %, the ink viscosity is increased, and ink ejection characteristic may be unstable.

The ink may contain a surface active agent. The surface active agent may be a compound having a structure including both a hydrophilic portion and hydrophobic portion in the molecule, and an anionic surface active agent, cationic surface active agent, amphoteric surface active agent, or nonionic surface active agent may be used. The high molecular dispersant mentioned above may also be used as a surface active agent.

Among them, from the viewpoint of dispersion stability of pigment, a nonionic surface active agent may be used. Further, from the viewpoint of permeability control, acetylene glycol, oxyethylene adduct of acetylene glycol, and polyoxy ethylene alkyl ether may be used.

The content of the surface active agent may be less than 10 mass %, 0.01 to 5 mass %, or 0.01 to 3 mass % of the ink. If the content is 10 mass % or more, optical density and storage stability of the pigment ink may be worsened.

The ink may also contain other additives for the purpose of control of characteristics such as improvement of ink ejection performance, and examples of the additives include polyethylene imines, polyamines, polyvinyl pyrrolidone, polyethylene glycol, ethyl cellulose, and carboxy methyl cellulose, additives for adjusting the conductivity or pH such as potassium hydroxide, sodium hydroxide, lithium hydroxide and other alkaline metal compounds, pH buffer, antioxidant, fungicide, viscosity regulator, conductive agent, ultraviolet absorber, and chelating agent, as required.

The processing liquid is not particularly limited as far as components for aggregating the pigment in the ink are contained. Specifically, for the ink containing a pigment having an anionic group, the processing liquid may contain a polyvalent metal salt or a cationic organic compound. Examples of polyvalent metal salts effectively used in the invention include salts of a polyvalent metal ion such as aluminum ion, barium ion, calcium ion, copper ion, iron ion, magnesium ion, manganese ion, nickel ion, tin ion, titanium ion and zinc ion, and hydrochloric acid, hydrobromic acid, hydroiodic acid, sulfuric acid, nitric acid, phosphoric acid, thiocyanic acid, acetic acid, oxalic acid, lactic acid, fumaric acid, citric acid, salicylic acid or benzoic acid.

Specific examples thereof include salts of polyvalent metals such as aluminum chloride, aluminum bromide, aluminum sulfate, aluminum nitrate, aluminum sodium sulfate, aluminum potassium sulfate, aluminum acetate, barium chloride, barium bromide, barium iodide, barium oxide, barium nitrate, barium thiocyanate, calcium chloride, calcium bromide, calcium iodide, calcium nitrite, calcium nitrate, calcium dihydrogenphosphate, calcium thiocyanate, calcium benzoate, calcium acetate, calcium salicylate, calcium tartarate, calcium lactate, calcium fumarate, calcium citrate, copper chloride, copper bromide, copper sulfate, copper nitrate, copper acetate, iron chloride, iron bromide, iron iodide, iron sulfate, iron nitrate, iron oxalate, iron lactate, iron fumarate, iron citrate, magnesium chloride, magnesium bromide, magnesium iodide, magnesium sulfate, magnesium nitrate, magnesium acetate, magnesium lactate, manganese chloride, manganese sulfate, manganese nitrate, manganese dihydrogenphosphate, manganese acetate, manganese salicylate, manganese benzoate, manganese lactate, nickel chloride, nickel bromide, nickel sulfate, nickel nitrate, nickel acetate, tin sulfate, titanium chloride, zinc chloride, zinc bromide, zinc sulfate, zinc nitrate, zinc thiocyanate, and zinc acetate.

The cationic compounds may be primary, secondary, tertiary or quaternary amines and their salts. Specific examples thereof include a tetra-alkyl ammonium salt, alkyl amine salt, benzalconium salt, alkyl pyridium salt, imidazolium salt, and polyamine, and for example, isopropyl amine, isobutyl amine, t-butyl amine, 2-ethyl hexyl amine, nonyl amine, dipropyl amine, diethyl amine, trimethyl amine, triethyl amine, dimethyl propyl amine, ethylene diamine, propylene diamine, hexamethylene diamine, diethylene triamine, tetraethylene pentamine, diethanol amine, diethyl ethanol amine, triethanol amine, tetramethyl ammonium chloride, tetraethyl ammonium bromide, dihydroxy ethyl stearyl amine, 2-heptadecenyl-hydroxy ethyl imidazoline, lauryl dimethyl benzyl ammonium chloride, cetyl pyridinium chloride, stearamide methyl pyridium chloride, diallyl dimethyl ammonium chloride polymer, diallyl amine polymer, and monoallyl amine polymer.

Examples of the electrolytes include aluminum sulfate, calcium chloride, calcium nitrate, calcium acetate, magnesium chloride, magnesium nitrate, magnesium sulfate, magnesium acetate, tin sulfate, zinc chloride, zinc nitrate, zinc sulfate, zinc acetate, aluminum nitrate, monoallyl amine polymer, diallyl amine polymer, and diallyl dimethyl ammonium chloride polymer.

For the ink containing a pigment having a cationic group on the surface, an anionic compound may be contained in the processing liquid. Examples of anionic compounds effectively used in the invention include organic carboxylic acid, organic sulfonic acid, and their salts. Examples of the organic carboxylic acid include acetic acid, oxalic acid, lactic acid, fumaric acid, citric acid, salicylic acid, and benzoic acid, and oligomers or polymers having plural such basic structures may also be used. Examples of the organic sulfonic acid include benzene sulfonic acid, toluene sulfonic acid, and oligomers or polymers having plural such basic structures may also be used.

The above compounds may be added in the processing liquid, either alone or in combination of two or more types. The content of such compounds in the processing liquid may be 0.1 to 15 mass %, or 0.5 to 10 mass %.

The processing liquid, like the ink, may also contain a surface active agent. Example of the surface active agent are the same as mentioned above.

Recording Apparatus of the Second Embodiment

In the ink jet recording apparatus of the second embodiment, as a humidity regulator, a housing 21 having the humidity regulating material in its inner wall is disposed to accommodate at least the droplet ejecting head, so that the humidity around the droplet ejecting head is regulated. As a result, the humidity near the nozzles 17 provided on the droplet ejecting surface (nozzle surface) of the droplet ejecting head can be regulated. At this time, the housing 21 may be disposed so as to include the nozzles 17 (ejector) of the droplet ejecting surface internally thereof, which is favorable for regulating the humidity near the nozzles 17.

Figure 6A:
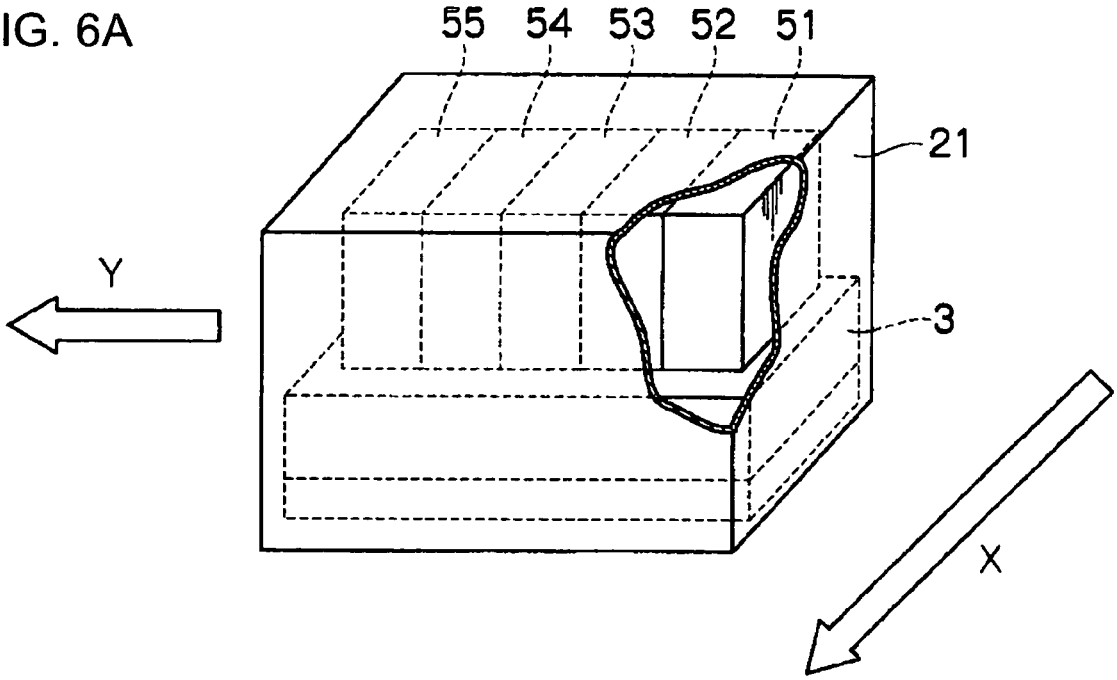
FIGS. 6A and 6B are enlarged perspective views of the surroundings of a recording head 3 of an ink jet recording apparatus in a second embodiment.
Figure 6B:
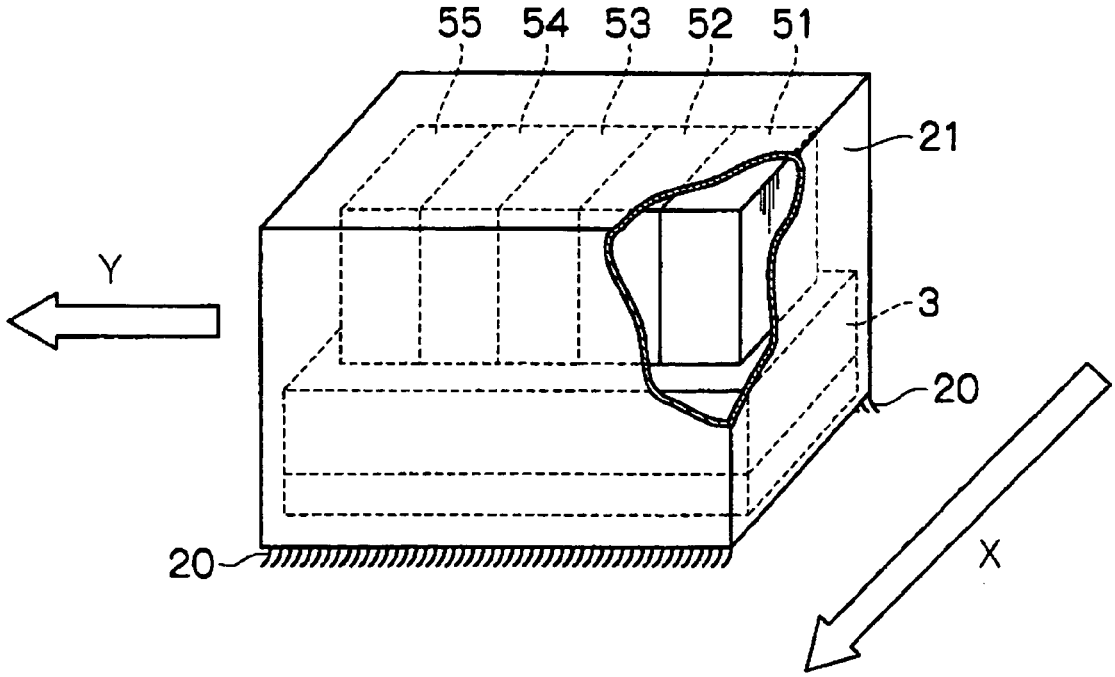

FIG. 6A and FIG. 6B are enlarged perspective views of the surroundings of the recording head 3 in this embodiment. In this embodiment, the sub ink tank 5 and recording head 3 are covered with the housing 21. As long as the housing 21 has the humidity regulating material in at least its inner wall, the entire inner wall may be covered with the humidity regulating material 18, or the humidity regulating material 18 may be adhered to the inner wall at intervals. Further, the housing 21 may be formed of the humidity regulating material 18.

In this case, as shown in FIG. 6A, in order to maintain the humidity near the nozzles 17 by the housing 21, the housing 21 is disposed so as to include the nozzle surface internally thereof to keep the humidity constant in the space between the nozzle surface and the conveying surface opposite to the nozzle surface. Further, as shown in FIG. 6B, a brush 20 contacting with the recording medium 1 may be provided at the end of the housing 21 so as not to disturb conveyance of the recording medium 1.

Except that the housing 21 is provided, the configuration of the ink jet recording apparatus in the second embodiment is the same as in the first embodiment, and further description of the configuration is omitted.

Recording Apparatus of the Third Embodiment

In the ink jet recording apparatus of the third embodiment, as a humidity regulator, a casing having the humidity regulating material in its inner wall is disposed so as to accommodate the entire apparatus, and the humidity in the apparatus, in particular, the humidity near the nozzles 17 (ejector), is regulated.

Figure 7:
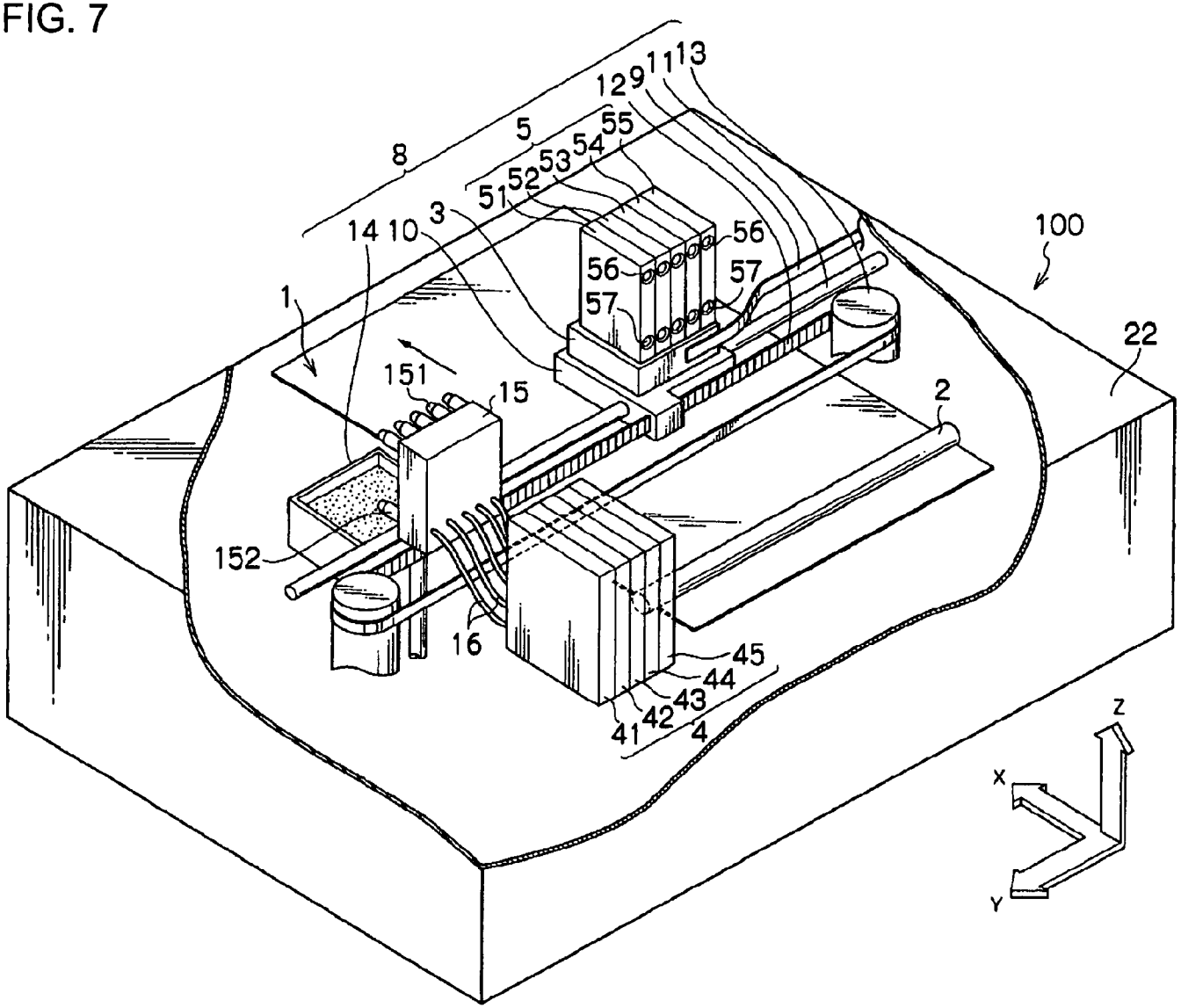
FIG. 7 is a perspective view showing a configuration of an ink jet recording apparatus in a third embodiment.

In the third embodiment, as shown in FIG. 7, the entire ink jet recording apparatus is covered with the casing 22. The casing 22 has the humidity regulating material 18 in at least its inner wall. The entire inner wall may be covered with the humidity regulating material 18, or the humidity regulating material 18 may be adhered to the inner wall at intervals. Further, the casing 22 may be formed of the humidity regulating material 18. By covering the entire apparatus with the casing 22 having the humidity regulating material 18 in the inner wall, the humidity in the apparatus can be regulated, and thereby the humidity near the nozzles 17 can be regulated.

Except that the casing 22 is provided, the configuration of the ink jet recording apparatus in the third embodiment is the same as in the first embodiment, and further description of the configuration is omitted.

In the first embodiment to the third embodiment, the individual configurations may be appropriately combined and used.

Recording Apparatus of the Fourth Embodiment

Figure 8:
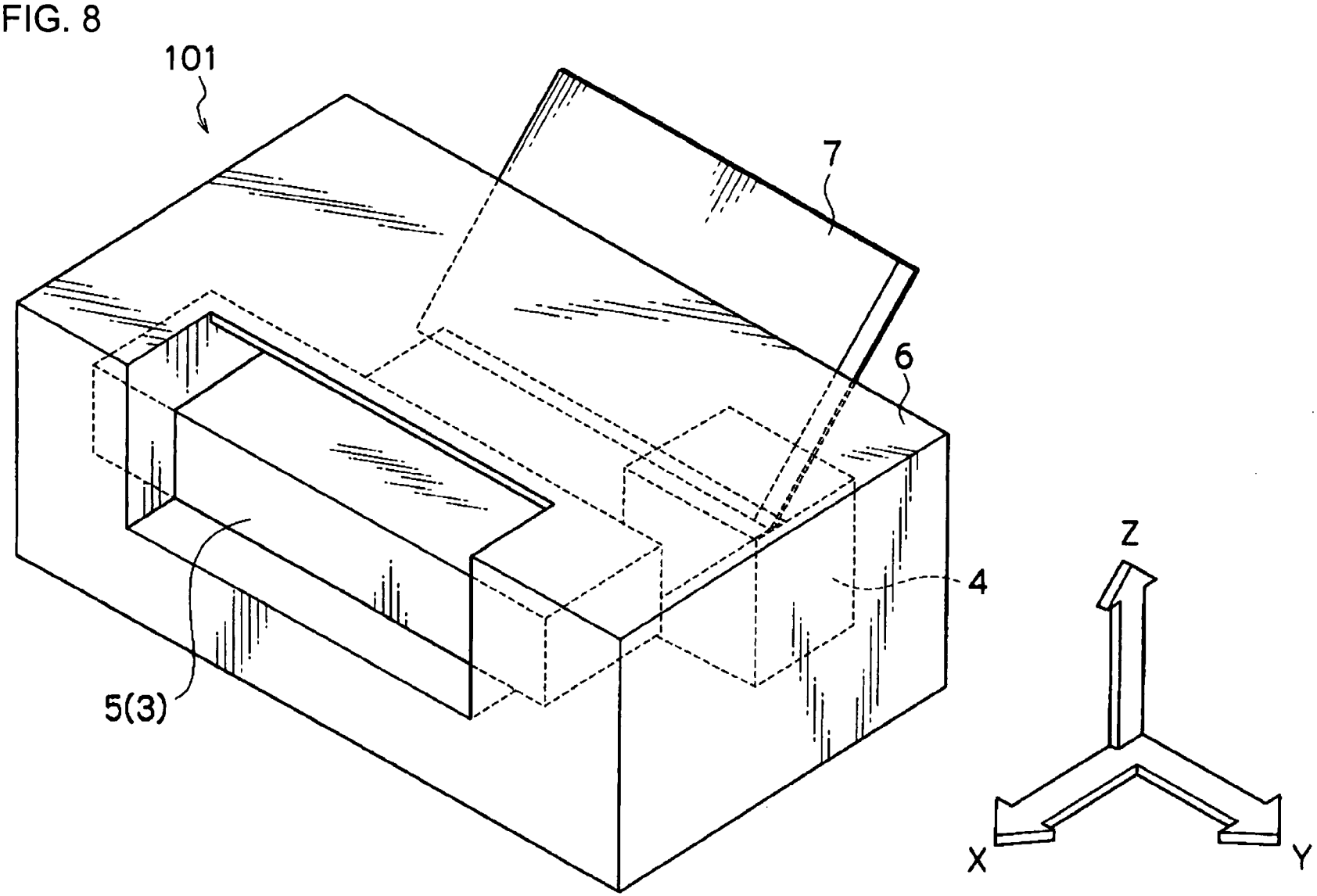
FIG. 8 is a perspective view showing an external appearance of an ink jet recording apparatus in a fourth embodiment.
Figure 9:
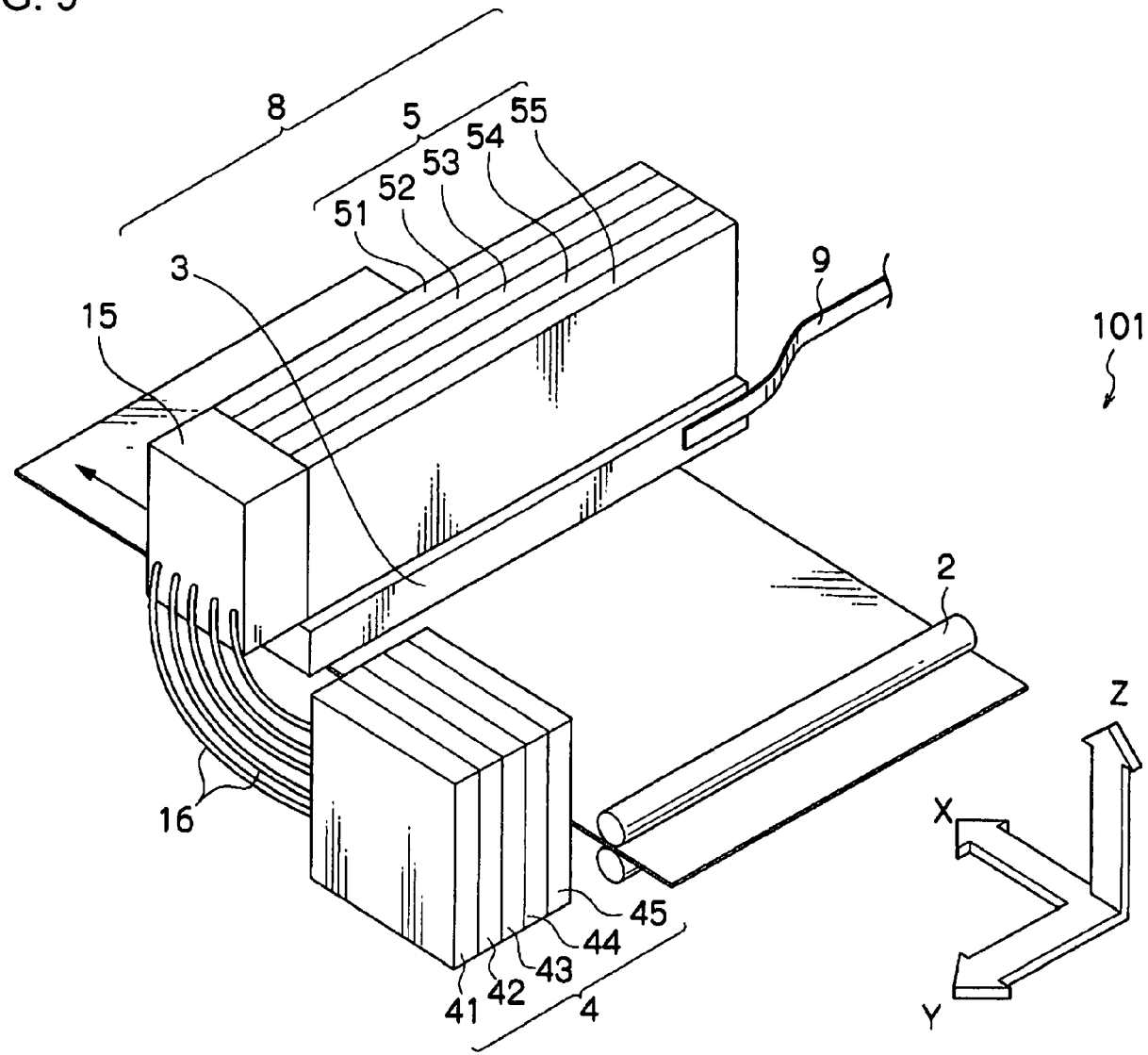
FIG. 9 is a perspective view showing an internal basic structure of the ink jet recording apparatus in FIG. 8.

FIG. 8 is a perspective view showing an external appearance of an ink jet recording apparatus in the fourth embodiment of the invention. FIG. 9 is a perspective view showing an internal basic structure of the ink jet recording apparatus (hereinafter called "recording apparatus") in FIG. 8. The recording apparatus 101 in this embodiment has a structure of forming an image by operating according to the ink jet recording method of the invention described above.

The recording apparatus 101 shown in FIG. 8 and FIG. 9 has the width of the recording head 3 that is the same as or more than the width of the recording medium 1 (Full Width Array, FWA), does not have a carriage mechanism, and includes a paper feed mechanism (a conveying roller 2 is shown in this embodiment, but it may be, for example, a belt type paper feed mechanism) in the sub-scanning direction (conveying direction of the recording medium 1: arrow X direction) (hereinafter an ink jet recording apparatus using an FWA type ink jet recording head (FWA head) may be called FWA type recording apparatus).

Figure 10A:
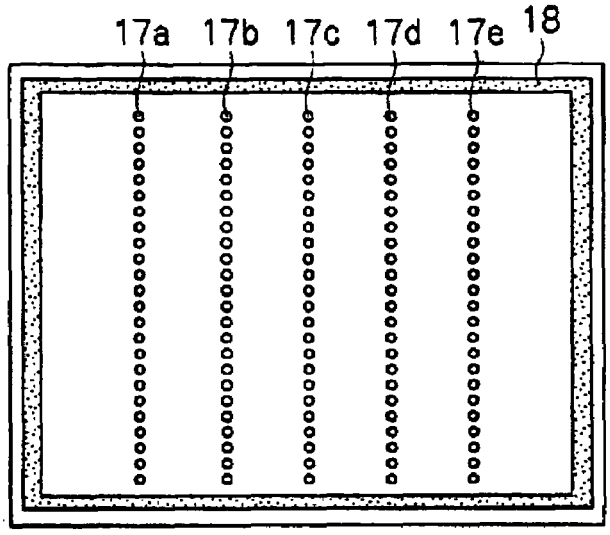
FIGS. 10A, 10B and 10C are schematic views showing a structure at the nozzle surface side of the recording head 3 in FIG. 9.
Figure 10B:
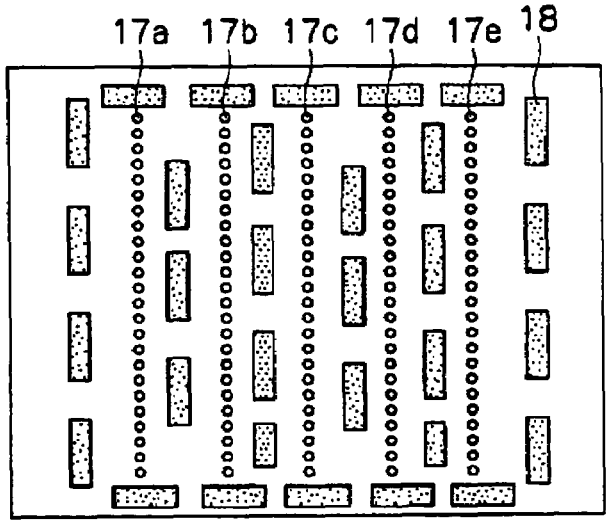
Figure 10C:
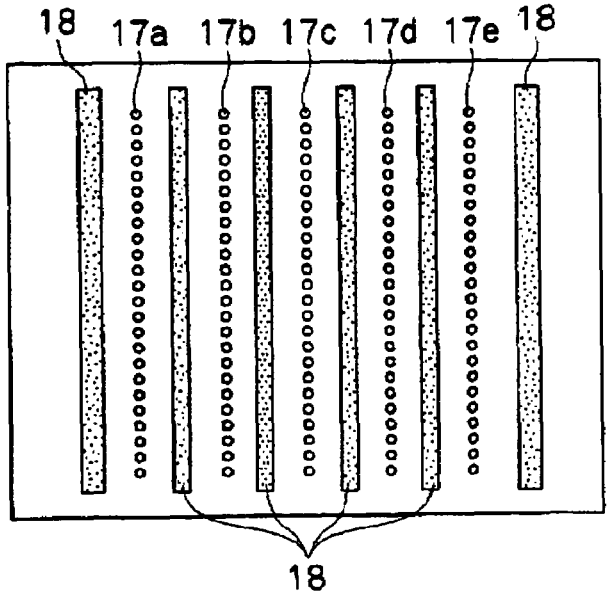

As shown in FIG. 10A, FIG. 10B, and FIG. 10C, ink tanks 51 to 55 are arrayed sequentially in the sub-scanning direction (conveying direction of the recording medium 1: arrow X direction), and similarly nozzle groups for ejecting colors (including a processing liquid) are arranged in the sub-scanning direction. Nozzle rows extend in the main scanning direction.

Other structure is the same as in the recording apparatus 100 shown in FIG. 1 and FIG. 2, and description thereof is omitted. Although, in the figures, the recording head 3 is not moved and thus the sub ink tank 5 is always connected to the replenishing device 15, the sub ink tank 5 may be connected to the replenishing device 15 only when refilling the ink.

In the recording apparatus 101 shown in FIG. 8 and FIG. 9, printing in the width direction (main scanning direction) of the recording medium 1 is executed at one time by the recording head 3, and thus the apparatus structure is simple and the printing speed is faster as compared with the apparatus having a carriage mechanism.

The ejector and humidity regulator of the fourth embodiment are further described.

FIG. 10A, FIG. 10B, and FIG. 10C are schematic views of the recording head 3 in FIG. 9 as seen from the nozzle surface side.

Corresponding to the ink tanks 51 to 55, nozzles 17*a* to 17*e* are linearly arranged in parallel to each other. In this embodiment, as a humidity regulator, the humidity regulating material 18 is disposed near the nozzles 17*a* to 17*e* (ejector), whereby the humidity near the ejector is regulated. The method of disposing the humidity regulating material 18 is not particularly limited, and for example, the humidity regulating material 18 may be disposed to surround the nozzle surface (droplet ejecting surface) of the recording head 3 as shown in FIG. 10A, or the humidity regulating material 18 may be disposed at intervals near the nozzles 17*a* to 17*e* as shown in FIG. 10B, or the humidity regulating materials 18 may be disposed parallel to the nozzles 17*a* to 17*e* disposed linearly as shown in FIG. 10C.

Figure 11A:
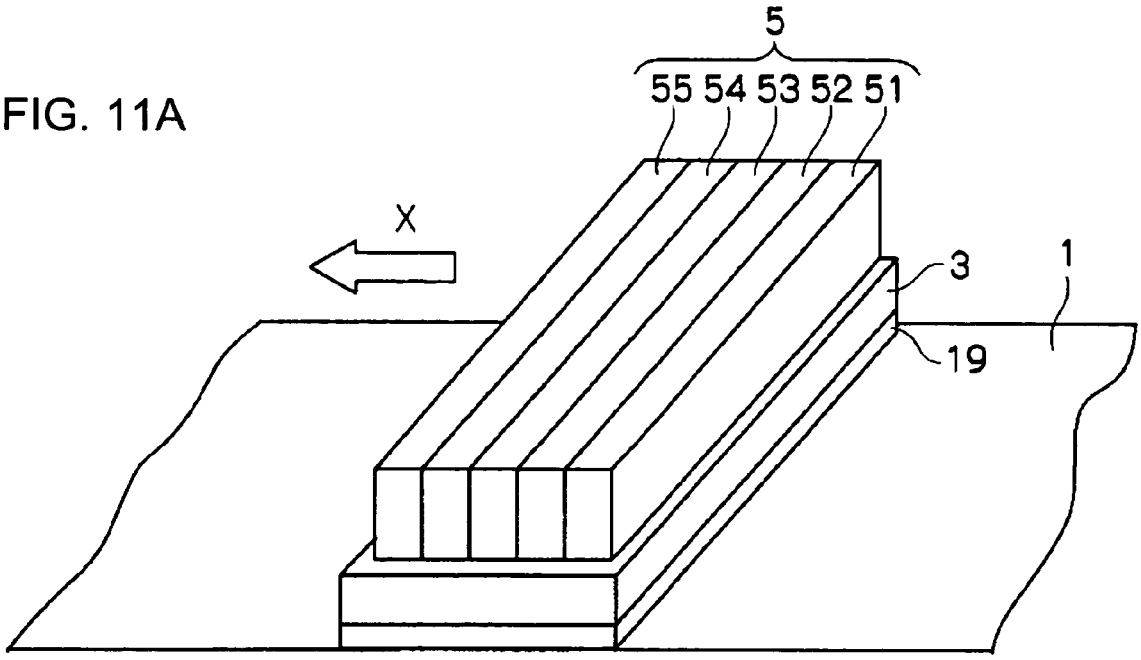
FIGS. 11A and 11B are enlarged perspective views of the surroundings of the recording head 3 in FIG. 9.
Figure 11B:
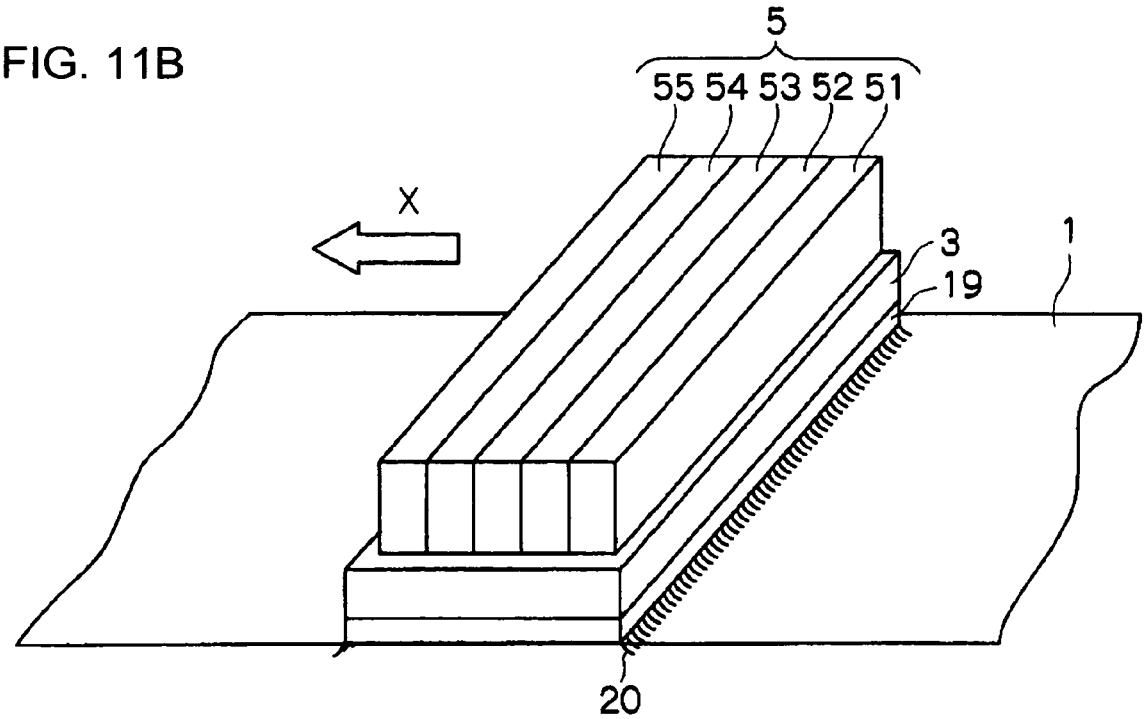

FIG. 11A and FIG. 11B are enlarged perspective views of the surroundings of the recording head 3. To further enhance the humidity regulating effect of the humidity regulating material 18 disposed near the nozzles 17*a* to 17*e*, an enclosure member, such as a wall member 19 extended from the recording head 3 as shown in FIG. 11A, may be disposed so as to enclose the nozzle surface. When disposing such a wall member 19, the wall member 19 is disposed so as to allow passing of the recording medium 1.

The humidity regulating material 18 is disposed at at least a part of the inner wall of the wall member 19. When the humidity regulating material 18 is provided at least in the inner wall, the entire surface of the inner wall of the wall member 19 may be covered with humidity regulating material 18, or the humidity regulating material 18 may be adhered to the inner wall at intervals. Further, the wall member 19 may be formed of humidity regulating material 18. As shown in FIG. 10A, FIG. 10B and FIG. 10C, when the humidity regulating material 18 is disposed on the nozzle surface, humidity regulating material 18 may not be provided in the wall member 19.

To further enhance the humidity regulating effect, as shown in FIG. 11B, a brush 20 contacting with the recording medium I may be provided at the end of the wall member 19 so as not to disturb conveying of the recording medium 1.

Recording Apparatus of the Fifth Embodiment

In the ink jet recording apparatus of the fifth embodiment, a housing 21 having a humidity regulating material 18 in its inner wall is disposed in a FWA type recording apparatus so as to accommodate the nozzles 17*a* to 17*e* (ejector), whereby the humidity near the ejector is regulated.

Figure 12A:
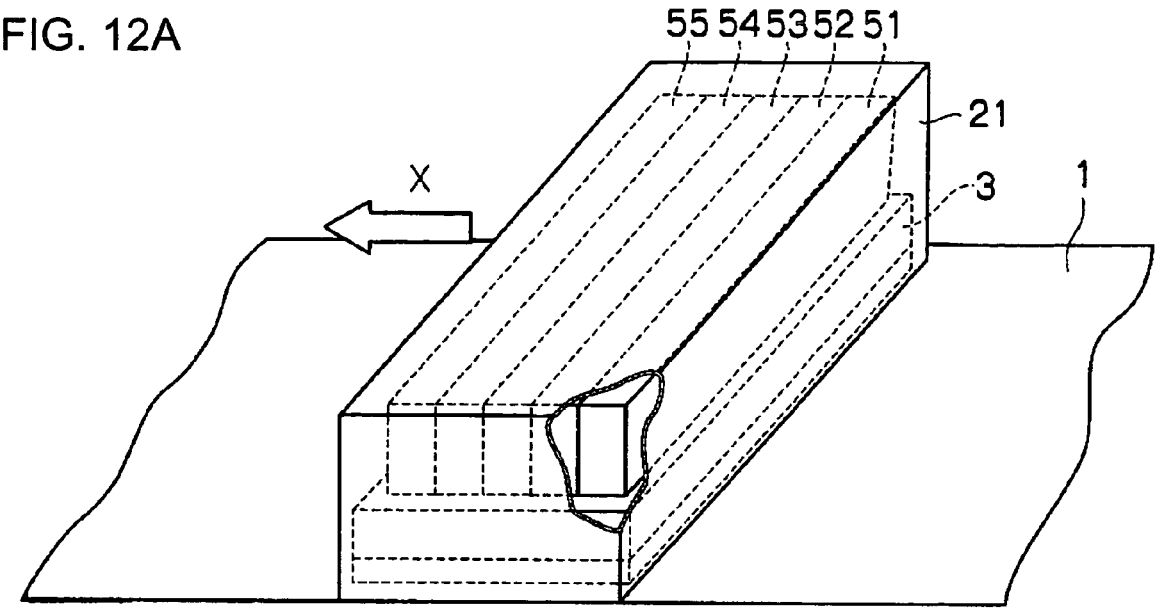
FIGS. 12A and 12B are enlarged perspective views of the surroundings of a recording head 3 of an ink jet recording apparatus in a fifth embodiment.
Figure 12B:
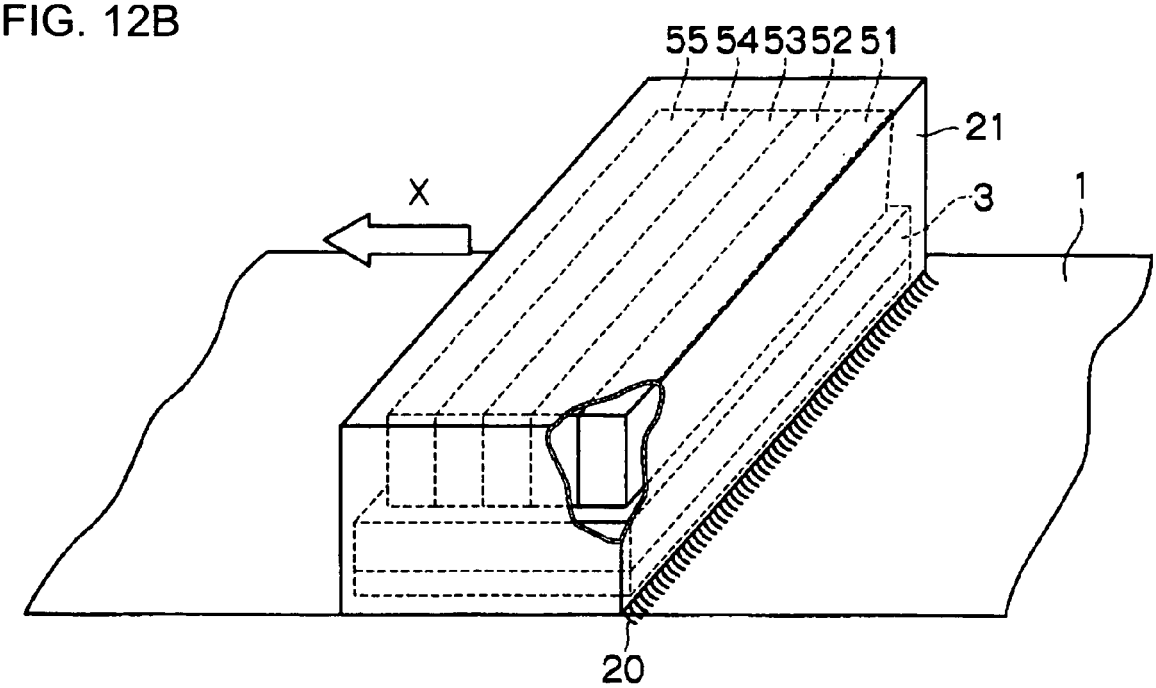

FIG. 12A and FIG. 12B are enlarged perspective views of the surroundings of the recording head 3 of the embodiment. In this embodiment, the sub ink tank 5 and recording head 3 are covered with the housing 21. The housing 21 has the humidity regulating material 18 disposed at least in the inner wall, and the entire surface of the inner wall may be covered with humidity regulating material 18, or the humidity regulating material 18 may be adhered to the inner wall at intervals. Further, the housing 21 may be formed of humidity regulating material 18.

In this case, as shown in FIG. 12A, to keep the humidity near the nozzles 17*a* to 17e by the housing 21, the housing 21 is disposed so as to include the nozzle surface in the inside thereof in order to keep the humidity constant in the space between the nozzle surface and the conveying surface opposite to the nozzle surface. Further, as shown in FIG. 12B, a brush 20 contacting with the recording medium 1 may be provided at the end of the housing 21 so as not to disturb conveying of the recording medium 1.

Except that the housing 21 is provided, the structure of the ink jet recording apparatus in this embodiment is the same as in the fourth embodiment, and further description of the structure is omitted.

Recording Apparatus of the Sixth Embodiment

In the ink jet recording apparatus of the sixth embodiment, a casing having a humidity regulating material 18 in its inner wall is disposed to a FWA type recording apparatus so as to accommodate the entire apparatus, and the humidity in the apparatus, in particular, the humidity near the nozzles 17*a* to 17*e* (ejector) is regulated.

Figure 13:
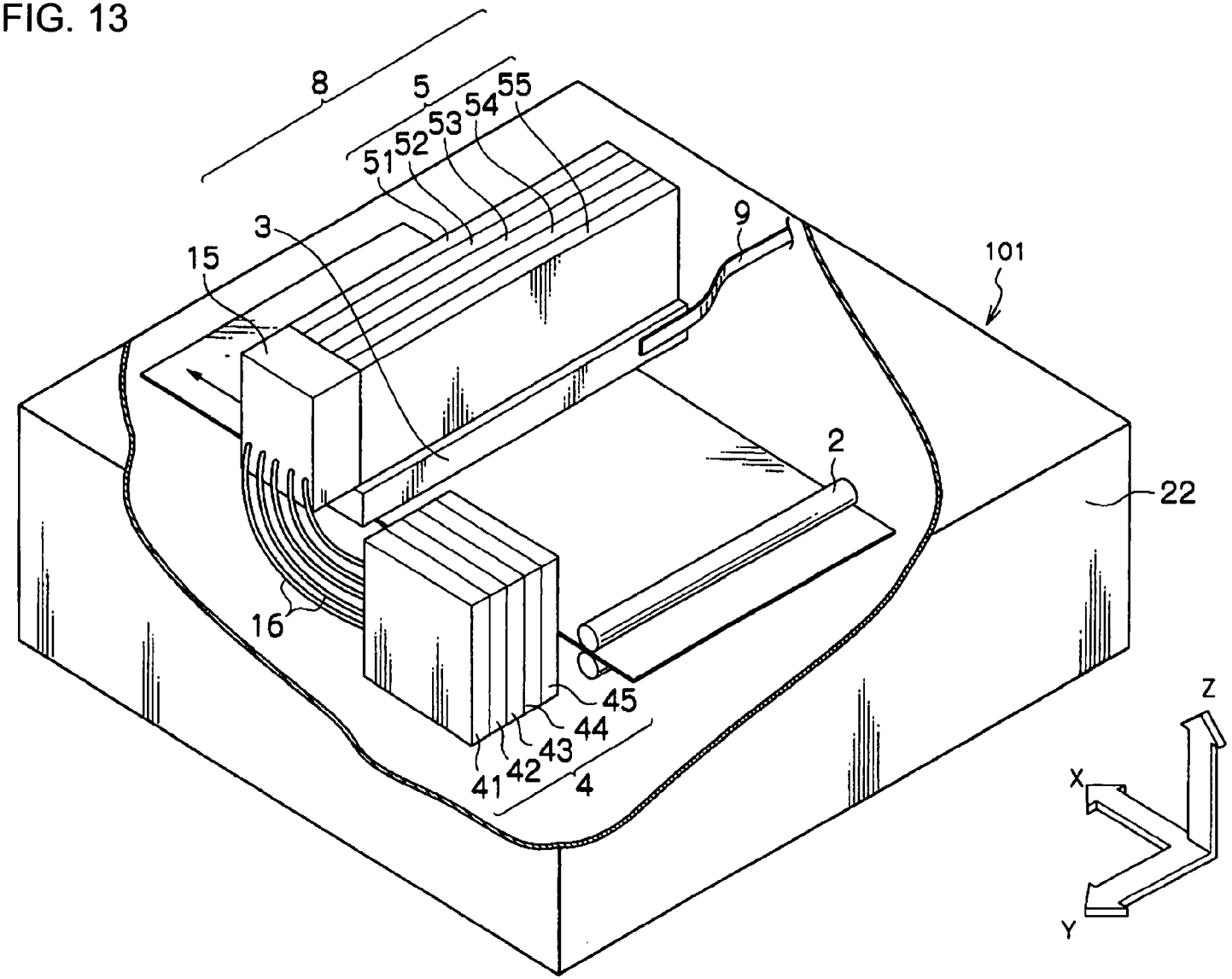
FIG. 13 is a perspective view showing a configuration of an ink jet recording apparatus in a sixth embodiment.

In the sixth embodiment, as shown in FIG. 13, the entire ink jet recording apparatus is covered with the casing 22. The casing 22 has the humidity regulating material 18 disposed at least in the inner wall, and the entire surface of the inner wall may be covered with humidity regulating material 18, or the humidity regulating material 18 may be adhered to the inner wall at intervals. Further, the casing 22 may be formed of humidity regulating material 18.

Except that the casing 22 is provided, the structure of the ink jet recording apparatus in the sixth embodiment is the same as in the fourth embodiment, and further description of the structure is omitted.

In the fourth embodiment to the sixth embodiment, the individual configurations may be appropriately combined and used.

Recording Apparatus of the Seventh Embodiment

In the seventh embodiment, in addition to the configuration of the first embodiment to the sixth embodiment, a moisture supplying device 24 that connects to a waste ink tank 23 and supplies moisture to the humidity regulating material 18 is provided. By making use of moisture in the waste ink collected in the waste ink tank 23, moisture is supplied to the humidity regulating material 18.

Figure 14A:
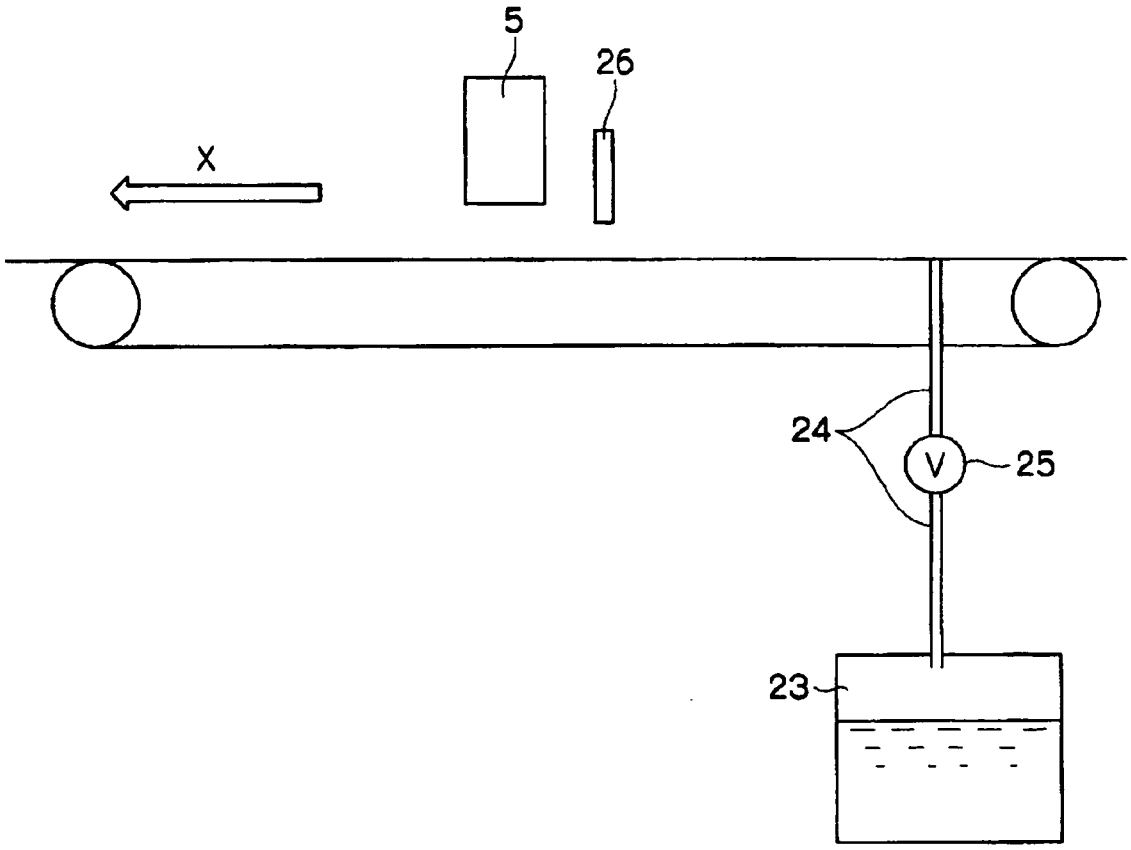
FIGS. 14A and 14B are schematic views showing a configuration of an ink jet recording apparatus in a seventh embodiment.
Figure 14B:
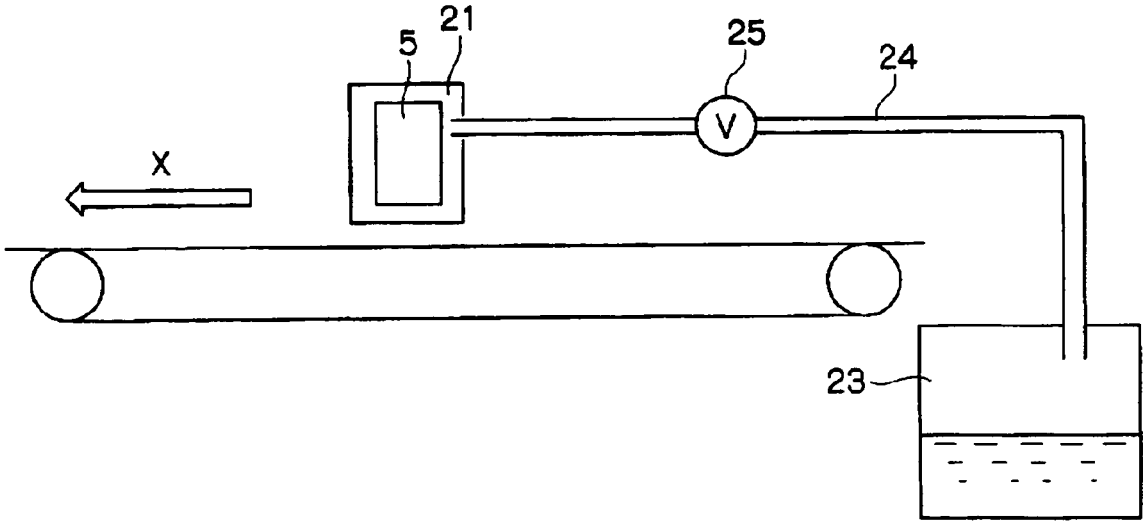

FIG. 14A and FIG. 14B are schematic views of an ink jet recording apparatus in the seventh embodiment. The moisture supplying device 24 may be provided with a valve 25 for adjusting the moisture to be supplied to the humidity regulating material 18. The valve 25 may be opened and closed manually, or automatically by a controller (not shown) to control opening and closing of the valve 25 depending on the result of detection by a humidity sensor 26 as a humidity detector that detects humidity near the nozzles (ejector)17 (17*a* to 17*e*). That is, by the controller, the valve 25 is opened when the humidity near the nozzles (ejector) 17 (17*a* to 17*e*) is lower than a specified value, and the valve 25 is closed when the humidity becomes higher than a specified value.

Location of the connection port that is connected with the moisture supplying device 24 is not particularly limited as far as moisture can be supplied to the humidity regulating material 18. For example, the connection port may be located at a position opposite to the nozzles (ejector)17 (17*a* to 17*e*), or the connection port may be provided at the upstream side of conveying of the recording medium 1 from the nozzles (ejector)17 (17*a* to 17*e*), as shown in FIG. 14A, so that the moisture of the waste ink can be supplied to the humidity regulating material 18 by the air stream generated by conveying of the recording medium 1.

When a housing 21 or casing 22 is provided as shown in the second, third, fifth and sixth embodiments, a connection port may be provided at a part of the wall of the housing 21 or casing 22 as shown in FIG. 14B.

For effective supply of moisture to the humidity regulating material 18, the connection port may be located near the humidity regulating material.

A fan (not shown) may also be provided in the moisture supplying device 24 for forcibly supplying moisture of evaporated waste ink. Driving of the fan may be synchronized with the controller for controlling opening and closing of the valve 25, and when the valve 25 is opened, the fan may be driven, and when the valve 25 is closed, the fan may be stopped. Aside from the controller for controlling opening and closing of the valve 25, another controller may be provided for controlling driving of the fan.

Recording Apparatus of the Eighth Embodiment

In the eighth embodiment, in addition to the configuration of the first embodiment to the sixth embodiment, a humidity assisting aqueous solution tank storing an aqueous solution containing a moisture retaining solvent is provided, and a moisture supplying device that connects to the humidity assisting aqueous solution tank and supplies moisture to the humidity regulating material is provided. If the humidity cannot be controlled by the moisture in the air alone, moisture is replenished to the humidity regulating material by using the moisture in the humidity assisting aqueous solution collected in the humidity assisting aqueous solution tank.

The humidity assisting aqueous solution may contain a humidity retaining solvent. The humidity retaining solvent may be polyhydric alcohols. Specific examples thereof include ethylene glycol, diethylene glycol, propylene glycol, butylene glycol, triethylene glycol, 1,5-pentanediol, 1,2,6-hexane triol, and glycerin. In particular, glycerin may be used.

The content of the humidity retaining solvent in the humidity assisting aqueous solution may be 5 to 90 mass %, or 30 to 70 mass %. If the content of the humidity retaining solvent in the humidity assisting aqueous solution is less than 5 mass %, evaporation of the humidity assisting aqueous solution may be excessive, so that the consumption may be very fast, but if more than 70 mass %, the moisture retaining power of the humidity assisting aqueous solution may be too strong, so that moisture supply to the surrounding of the ejector may not be sufficient.

The humidity assisting aqueous solution may also contain preservatives, fungicides, or bactericides.

The ink jet recording apparatus of the eighth embodiment is the same as the ink jet recording apparatus of the seventh embodiment, except that the waste ink tank 23 is replace by the humidity assisting aqueous solution tank, and the connecting method and others are the same as in the seventh embodiment, and thus further explanation is omitted.

Recording Apparatus of the Ninth Embodiment

In the ninth embodiment, in addition to the configuration of the first embodiment to the sixth embodiment, a humidifier is provided, and a moisture supplying device that connects to the humidifier and supplies moisture to the humidity regulating material is provided. By making use of moisture generated from the humidifier, moisture is supplied to the humidity regulating material.

The ink jet recording apparatus of the ninth embodiment is the same as the ink jet recording apparatus of the seventh embodiment, except that the waste ink tank 23 is replace by the humidifier, and the connecting method and others are the same as in the seventh embodiment, and thus further explanation is omitted.

[Cap]

The cap of the invention is to maintain in an airtight condition a droplet ejecting port for ejecting droplets by an ink jet system, and contains a humidity regulating material containing an inorganic porous material at least in its inner wall.

As the humidity regulating material used in the cap of the invention, for example, the above-mentioned humidity regulating material for the recording apparatus of the first embodiment can be used.

Because the humidity regulating material is included in the cap, the humidity around the nozzles inside the cap is kept constant, so that nozzle clogging due to drying of the ambient air can be prevented.

Configuration of the cap of the ink jet ejecting head of the invention is explained with reference to the drawings.

Figure 15:
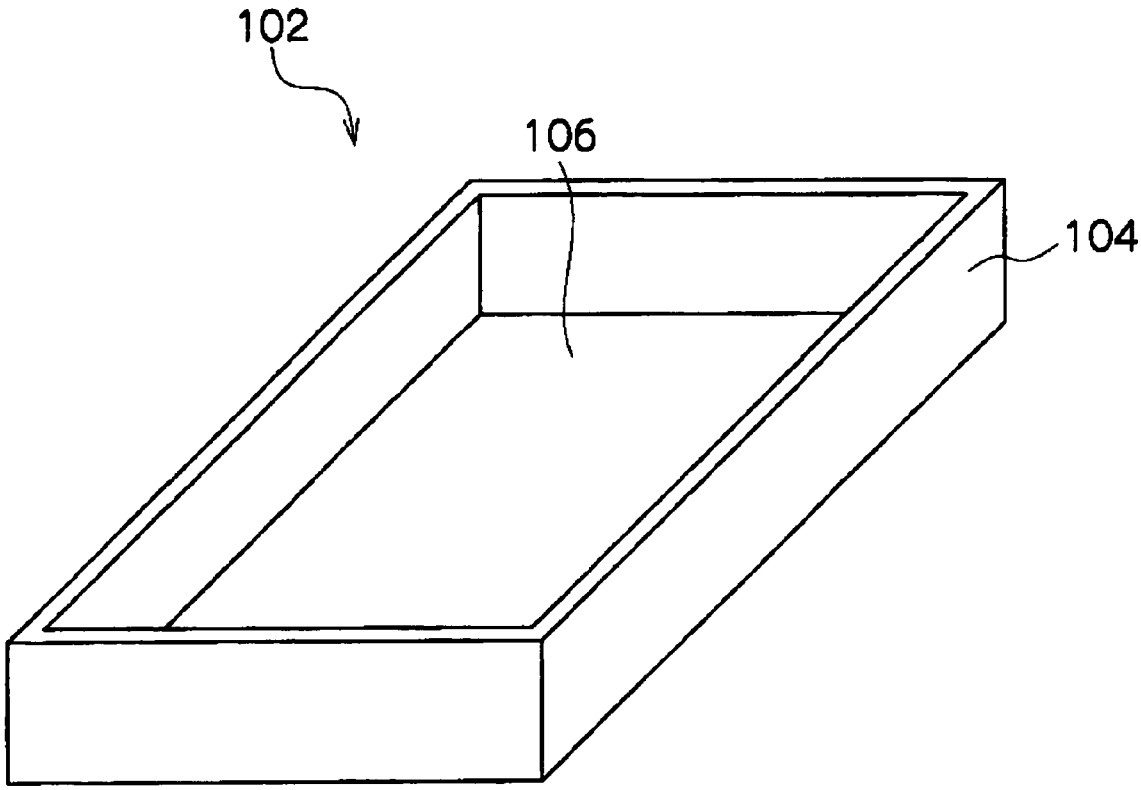
FIG. 15 is a perspective view showing a cap for an ink jet ejecting head of the invention.

FIG. 15 is a perspective view showing an example of a cap of an ink jet ejecting head of the invention. The cap in FIG. 15 is a cap of a shallow box shape, but the shape of the cap is not particularly limited.

The cap 102 in FIG. 15 is composed of wall members 104 and a bottom member 106. The wall members 104 are formed of the humidity regulating material. As shown in FIG. 15, the wall members 104 may be composed of the humidity regulating material, or the humidity regulating material may be adhered to the inner walls of the wall members 104. When adhering the humidity regulating material to the inner wall, the entire surface of the inner wall may be formed of the humidity regulating material, or the humidity regulating material may be adhered in part.

The material of the bottom member 106 is not particularly limited, but it may be durable enough not to dissolve or deform with ink or liquid ejected from the nozzles. Such a material may be polyphenylene sulfide, polyphenylene oxide, polybutylene terephthalate and other thermoplastic resins.

Figure 16:
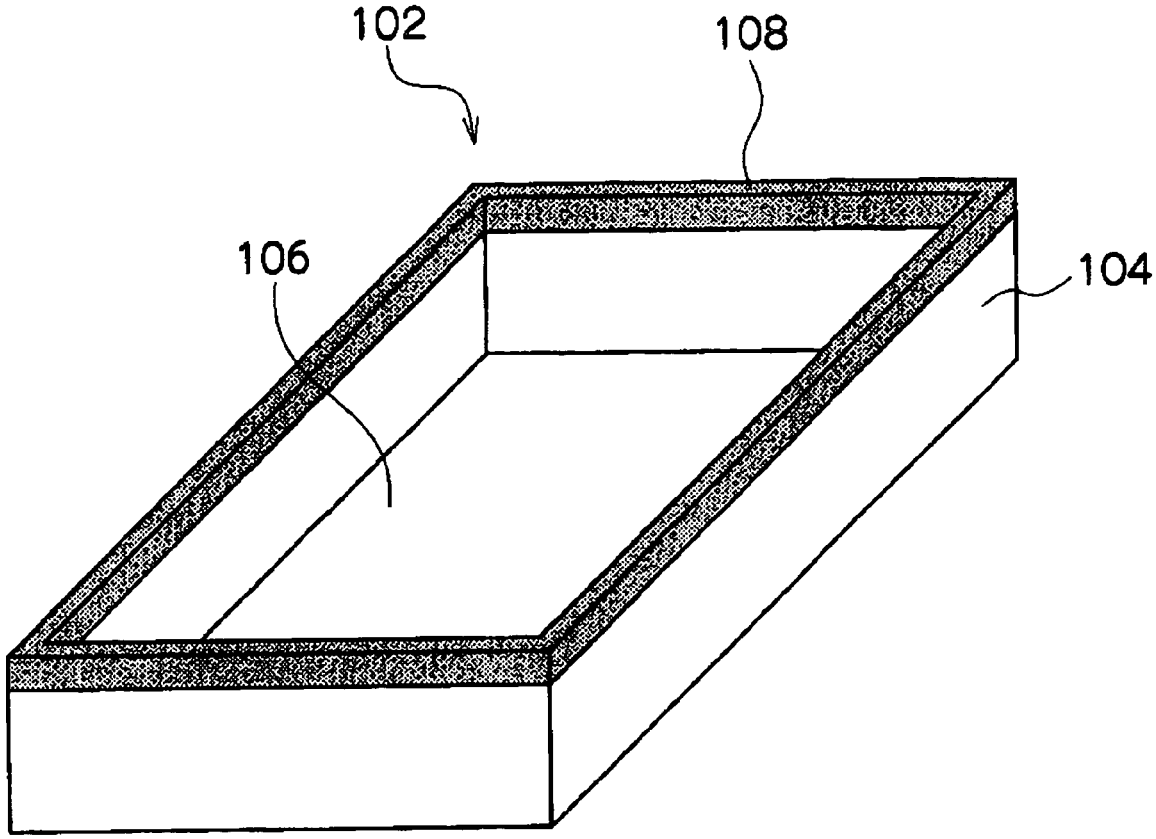
FIG. 16 is a perspective view showing another structure of a cap for an ink jet ejecting head of the invention.

To enhance the tightness of the cap of the invention with the ejecting head, as shown in FIG. 16, a rubber member 108 may be provided on the brim of the wall member 104. The rubber member 108 may be a natural rubber, synthetic rubber, polyurethane rubber or other elastomer materials.

The configuration of the droplet ejecting apparatus having the cap of the invention (droplet ejecting apparatus of the second aspect of the invention) is described below.

The droplet ejecting apparatus of the second aspect of the invention includes an ejector that ejects a droplet by an ink jet system, and the cap for maintaining the droplet ejecting port of the ejector in an airtight condition, and the droplet ejecting port is airtightly capped while not recording (while not ejecting).

The droplet ejecting apparatus may be an ink jet recording apparatus using ink, or may be a forming apparatus that forms a resin product by ejecting a droplet containing resin.

Referring to the drawings, exemplary embodiments of the droplet ejecting apparatus of the second aspect of the invention are specifically described below, and at first an ink jet recording apparatus using ink as liquid (recording apparatus in tenth to fourteenth embodiments) is explained, and then a forming apparatus for forming a resin product by ejecting a liquid containing resin is explained.

In the drawings, members having substantially the same functions are identified with same reference numerals, and duplicate explanations are omitted.

Recording Apparatus of the Tenth Embodiment

Figure 17:
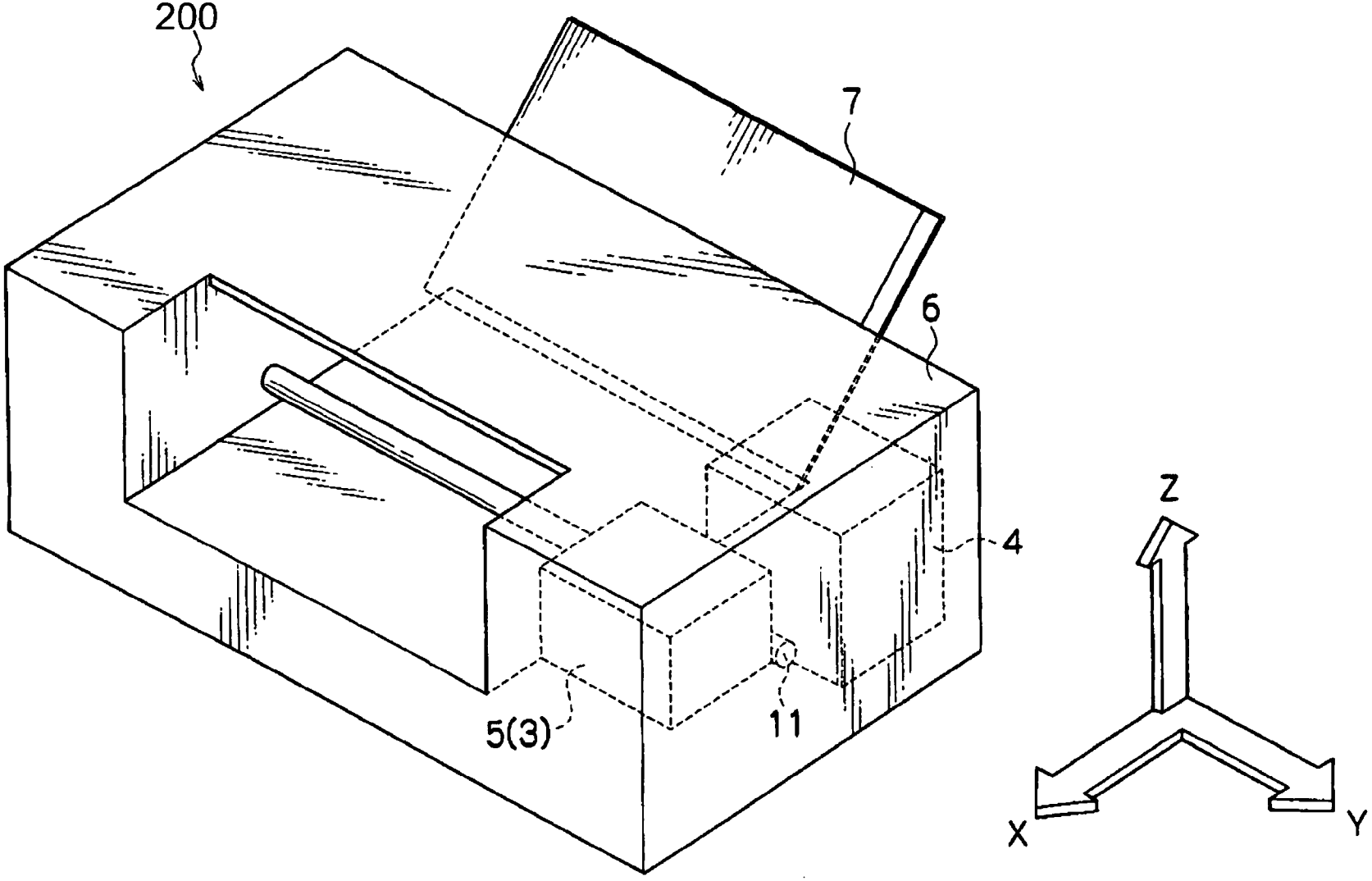
FIG. 17 is a perspective view showing an external appearance of an ink jet recording apparatus in a tenth embodiment.
Figure 18:
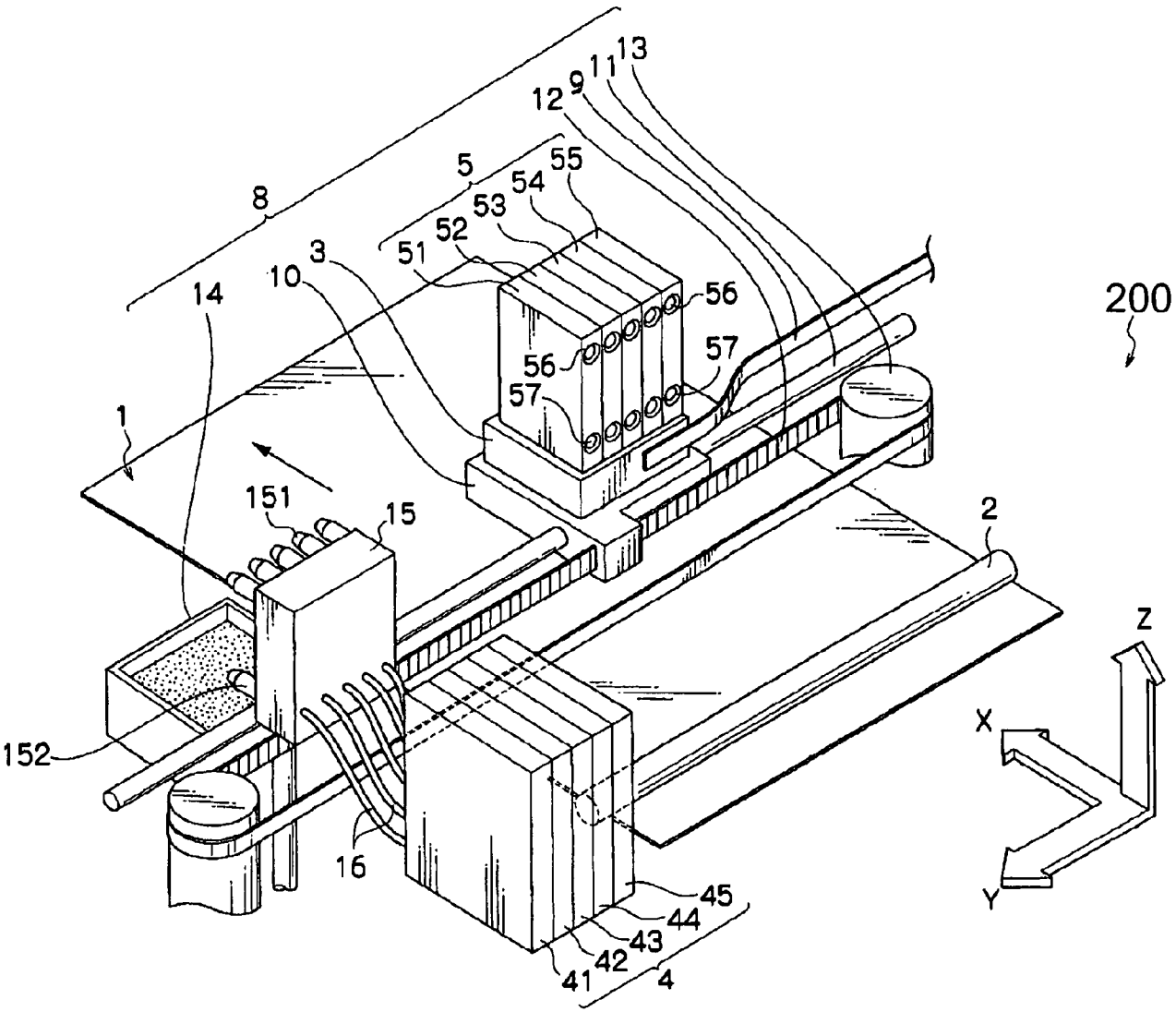
FIG. 18 is a perspective view showing an internal basic structure of the ink jet recording apparatus in FIG. 17.

FIG. 17 is a perspective view showing an external appearance of an exemplary embodiment of an ink jet recording apparatus in the tenth embodiment. FIG. 18 is a perspective view showing an internal basic structure of the ink jet recording apparatus (hereinafter called "recording apparatus") in FIG. 17.

The recording apparatus 200 of the embodiment mainly includes, as shown in FIG. 17 and FIG. 18, an outer cover 6, a tray 7 for stacking up a specified number of sheets of a recording medium 1 such as plain paper, a conveying roller (conveying device) 2 for conveying the recording medium 1 one by one into the recording apparatus 200, an image forming unit 8 (image forming device) for forming an image by ejecting ink and liquid composition on the surface of the recording medium 1, and a main ink tank 4 for replenishing a sub ink tank 5 with ink and processing liquid.

The conveying roller 2 is a paper feed mechanism composed of a pair of rollers disposed rotatably in the recording apparatus 200, and holds the recording medium 1 mounted on the tray 7, and conveys a specified amount of the recording medium 1 into the apparatus 200 one by one at specified timing.

The image forming unit 8 forms an ink image on the surface of the recording medium 1. The image forming unit 8 is mainly composed of a recording head 3 (ejector), sub ink tank 5, power feed signal cable 9, carriage 10, guide rod 11, timing belt 12, drive pulley 13, and maintenance unit 14.

The sub ink tank 5 has ink tanks 51, 52, 53, 54 and 55 containing inks of different colors or liquid compositions as available for ejection. For example, as inks for ink jet, black ink (K), yellow ink (Y), magenta ink (M), cyan ink (C), and processing liquid are contained. If processing liquid is not used, or if processing liquid contains color material, an ink tank for processing liquid is not needed.

The sub ink tank 5 has exhaust holes 56 and refill holes 57. When the recording head 3 moves to a waiting position (or a refill position), exhaust pins 151 and refill pins 152 of an replenishing device 15 are inserted into the exhaust holes 56 and refill holes 57, and thus the sub ink tank 5 and replenishing device 15 connect with each other. The replenishing device 15 is connected to the main ink tank 4 through refill tubes 16, and the inks and processing liquid are supplied from the main ink tank 4 into the sub ink tank 5 through the refill tubes 57 by means of the replenishing device 15.

The main ink tank 4 also has main ink tanks 41, 42, 43, 44, and 45 containing inks of different colors and processing liquid. For example, as the first liquids, black ink (K), yellow ink (Y), magenta ink (M), cyan ink (C) are contained, and as the second liquid, a processing liquid is contained, and these tanks are detachably installed in the recording apparatus 200.

Further, as shown in FIG. 18, the power feed signal cable 9 and sub ink tank 5 are connected to the recording head 3, and when external image recording information is entered in the recording head 3 through the power feed signal cable 9, the recording head 3 sucks a specified amount of ink from each ink tank on the basis of this image recording information, and ejects the ink on the surface of a recording medium. The power feed signal cable 9 also plays a role of feeding electric power necessary for driving the recording head 3 into the recording head 3, aside from the image recording information.

The recording head 3 is disposed and held on a carriage 10, and a guide rod 11 and a timing belt 12 connected to drive pulleys 13 are connected to the carriage 10. Owing to this configuration, the recording head 3 can move, along the guide rod 11, in the direction Y (main scanning direction) that is vertical to the conveying direction X (sub scanning direction) of the recording medium 1 and is parallel to the surface of the recording medium 1.

The recording apparatus 200 includes controller (not shown) that controls the driving timing of the recording head 3 and the driving timing of the carriage 10 on the basis of image recording information. Accordingly, along the conveying direction X, an image can be continuously formed according to the image recording information in a specified area of the surface of the recording medium 1 conveyed at specified speed.

The recording head 3 of the embodiment also has nozzles as ink eject ports (not shown), liquid passages, an energy applying section (not shown) provided at a part of the liquid passages, and energy generator (not shown) that generates droplet forming energy to be applied to the ink existing in the energy applying section.

Examples of the energy generator includes, for example, a piezo ink jet recording system using an electrodynamic transducer, a recording system of using an energy generator for ejecting droplets by a thermal action by emitting laser or electromagnetic waves to generate heat, and a thermal ink jet recording system of ejecting liquid by heating the liquid by an electrothermal transducer such as exothermic elements having a heating resistance.

From the viewpoint of improvement of bleeding and intercolor bleeding, the ink jet recording apparatus of the embodiment may use a thermal ink jet recording system or piezo ink jet recording system. The reason is not clear, but in the case of the thermal ink jet recording system, the ink is heated and the viscosity thereof is lowered at the time of ejection, and since the ink temperature is lowered on the recording medium, the viscosity increases suddenly. It is therefore considered that bleeding and intercolor bleeding are improved. In the case of a piezo ink jet system, on the other hand, liquid of high viscosity can be ejected, and the liquid of high viscosity can suppress spreading in the paper surface direction on the recording medium, and it is therefore considered that bleeding and intercolor bleeding are improved.

The maintenance unit 14 is connected to a pressure reducing device (pump, see FIG. 20) through a tube. This maintenance unit 14 is connected to the nozzle portion of the recording head 3, and the pressure in the nozzles of the recording head 3 is reduced, so that the ink can be sucked off from the nozzles of the recording head 3. By this maintenance unit 14, as required, extra ink sticked to the nozzles can be removed during operation of the recording apparatus 200, or evaporation of ink from the nozzles can be suppressed while the operation is stopped.

Figure 19A:
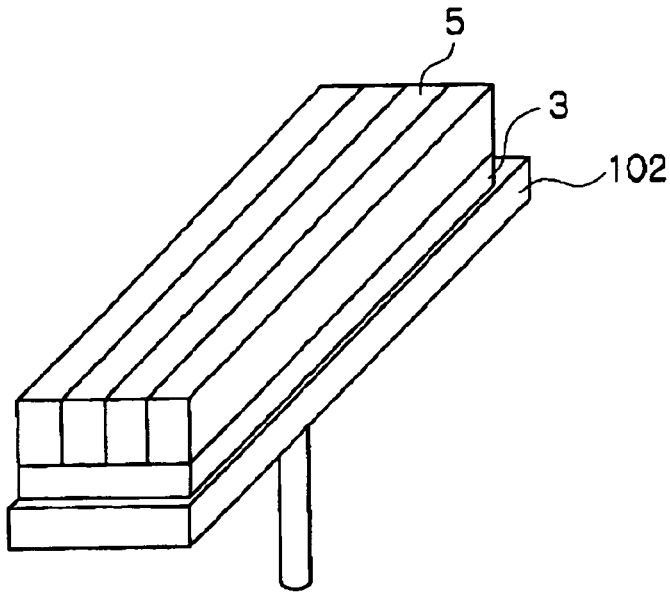
FIGS. 19A, 19B and 19C are views showing a case where the cap is fixed on the recording head 3 which is not recording (not ejecting) in the ink jet recording apparatus in FIG. 17.
Figure 19B:
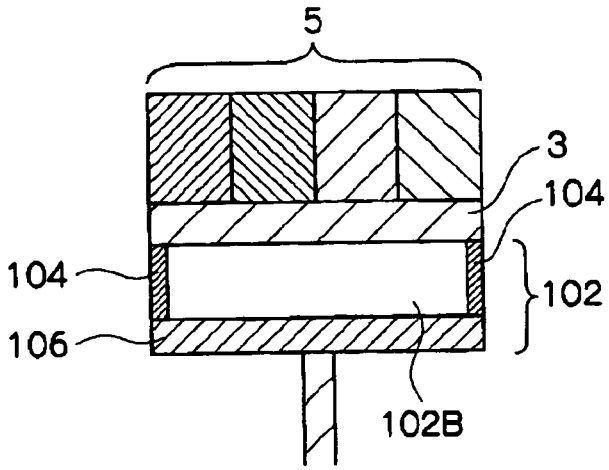
Figure 19C:
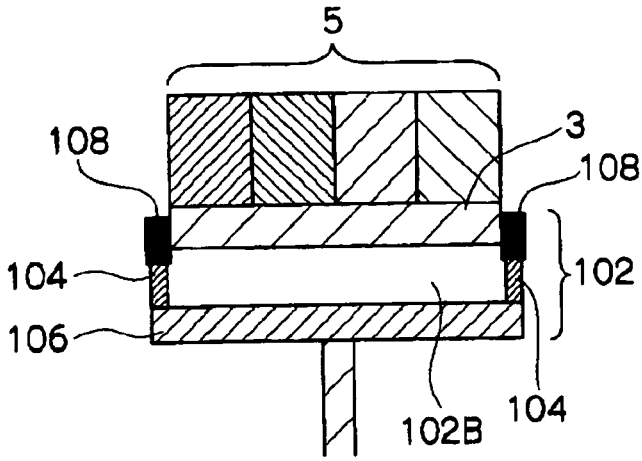

FIG. 19A, FIG. 19B, and FIG. 19C show the case where the cap is fixed to the recording head 3 while not recording (while not ejecting). FIG. 19A is a perspective view showing around the recording head 3 when the cap 102 is fitted tightly, and FIG. 19B and FIG. 19C are sectional views. In the drawings after FIG. 19A, FIG. 19B, and FIG. 19C, the carriage 10 is omitted for understanding of the invention.

In the ink jet recording apparatus of the tenth embodiment of the invention, while image is not recorded, that is, while ink is not ejected from the nozzles, the cap 102 of the invention is fitted tightly to the recording head 3 by an elevating mechanism not shown.

In the ink jet recording apparatus of the embodiment, as mentioned above, since the cap 102 has a humidity regulating material at least in its inner wall, the humidity in the cap space 102B between the nozzle surface and the cap can be adjusted.

In FIG. 19B, the cap is tightly fitted to the nozzle surface, but as shown in FIG. 19C, the cap may be tightly fitted to the wall side of the recording head 3. In the structure shown in FIG. 19C, to increase the tightness of the cap and the recording head 3, or to prevent damage when mounting, a rubber member 108 may be disposed on the brim of the cap. Of course in FIG. 19B, a rubber member 108 may be disposed on the brim of the cap from the viewpoint of tightness.

In the ink jet recording apparatus of the second aspect of the invention, the ink and processing liquid (recording liquids) to be contained in the sub ink tank 5 may be, for example, the same as the above-mentioned ink and processing liquid (recording liquids) for the recording apparatus of the first embodiment.

Recording Apparatus of the Eleventh Embodiment

In the ink jet recording apparatus of the eleventh embodiment, the cap 102 of the invention is provided as a part of the maintenance unit 14. Other structure is the same as in the recording apparatus of the tenth embodiment, and further explanation is omitted.

Figure 20:
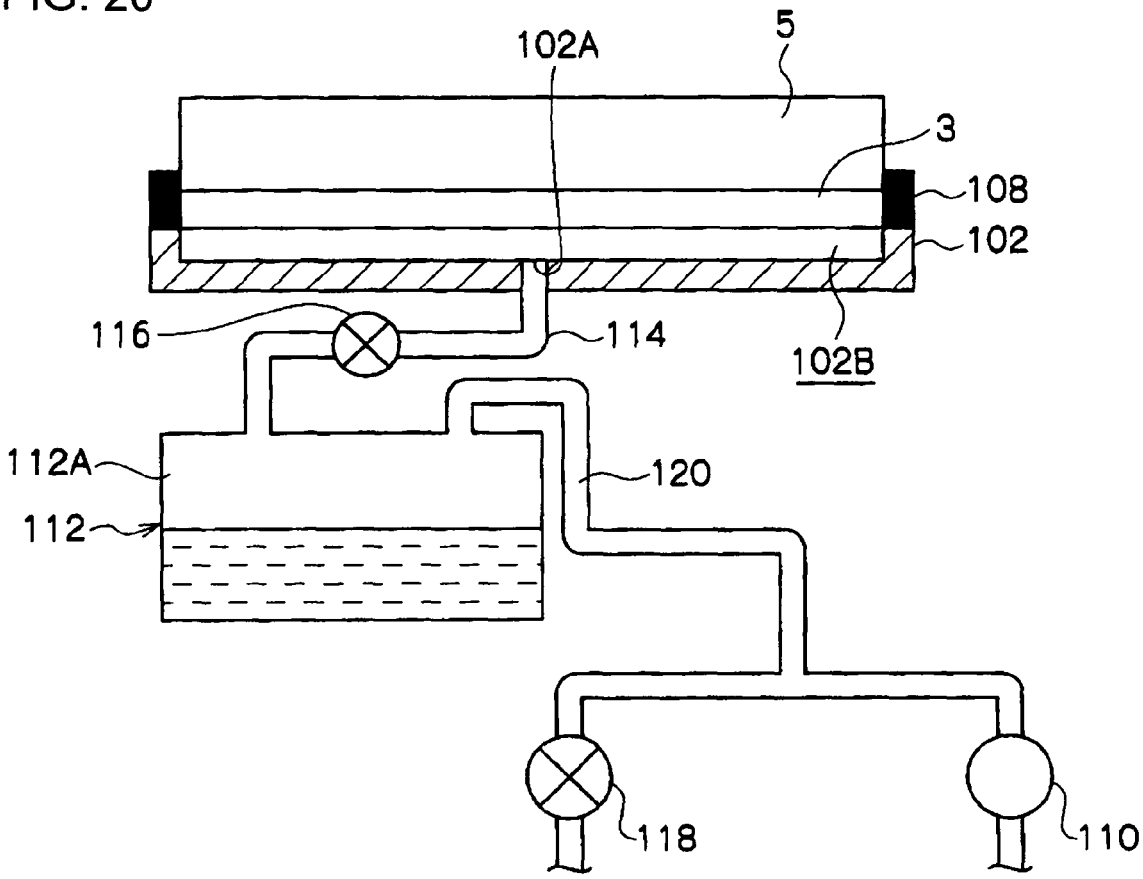
FIG. 20 is a schematic view showing a maintenance unit having a cap of the invention in an ink jet recording apparatus in an eleventh embodiment.

FIG. 20 is a schematic view of a maintenance unit 14 having the cap 102 of the invention.

The maintenance unit 14 includes a dummy jet receiving part (not shown), cleaning blade (not shown), pump (suction device) 110, cap 102 and others, and performs maintenance operations such as a dummy jet operation, cleaning operation, ink suction operation, etc.

The ink suction operation is an operation for recovering ejecting characteristics by fitting the cap 102 tightly to the nozzle surface of the recording head 3 and sucking the ink from the ink ejecting nozzles when the ejecting performance of ink droplets ejected from the ink ejecting nozzles is worsened or when defective ejection occurs.

Operation for recovering ejecting characteristics is explained.

As shown in FIG. 20, the cap 102 connects to a waste ink tank 112 collecting waste ink through a connecting part (tube) 114, and the tube 114 has a valve 116.

In the bottom member of the cap 102, an opening 102A is provided, and the connecting part (tube) 114 is connected to the opening 102A.

The connecting part (tube) 114 is connected to an upper part of the waste ink tank 112 to connect to a closed hollow space 11 2A, and is connected to a tube 120 linked to a valve 118 and pump 110 through the hollow space 112A. By the valve 118 and pump 110, a cap space 102B closed between the nozzle surface and cap 102 is evacuated or pressurized up to the atmospheric pressure. When the cap space 102B is evacuated, the ink is sucked from the ink ejecting nozzles, and the ejecting performance can be recovered.

Device that supplies moisture in the waste ink tank into the cap space 102B is explained.

The waste ink tank 112 and cap space 102B connect to each other by way of a valve 116, and by making use of moisture of waste ink, the humidity in the cap space 102B can be adjusted by opening and closing the valve 116. Since the cap space 102B and waste ink tank 112 connect to each other, the inside of the cap space 102B can be stabilized in high humidity state by supply of moisture from the waste ink tank 112, in addition to the effect of humidity regulation by the humidity regulating material.

The valve 116 may be opened and closed manually, or automatically by a controller (not shown) to control opening and closing of the valve 116 depending on the result of detection by a humidity sensor (not shown) as a humidity detector that detects the humidity in the cap space. That is, by the controller, the valve 116 is opened when the humidity in the cap space is lower than a specified value, and the valve 116 is closed when the humidity becomes higher than a specified value.

A fan (not shown) may be provided for forcibly supplying moisture of evaporated waste ink. Driving of the fan may be synchronized with the controller for controlling opening and closing of the valve 116, and when the valve 116 is opened, the fan may be driven, and when the valve 116 is closed, the fan may be stopped. Aside from the controller for controlling opening and closing of the valve 116, another controller may be provided for controlling driving of the fan. Or the fan may be driven manually.

In the ink jet recording apparatus of the eleventh embodiment of the invention, since the cap 102 has a humidity regulating material at least in its inner wall, the humidity in the cap space 102B can be regulated without supply of moisture from the waste ink tank.

Recording Apparatus of the Twelfth Embodiment

In the recording apparatus of the twelfth embodiment, a humidity assisting aqueous solution tank storing an aqueous solution containing a moisture retaining solvent is provided, and a connecting part 114 is provided for connecting between the humidity assisting aqueous solution tank and the cap 102. If the humidity cannot be controlled by the moisture in the air alone, moisture is supplied into the cap space 102B by making use of moisture in the humidity assisting aqueous solution stored in the humidity assisting aqueous solution tank.

The humidity assisting aqueous solution may be, for example, the same as the humidity assisting aqueous solution for the recording apparatus in the eighth embodiment.

Figure 21:
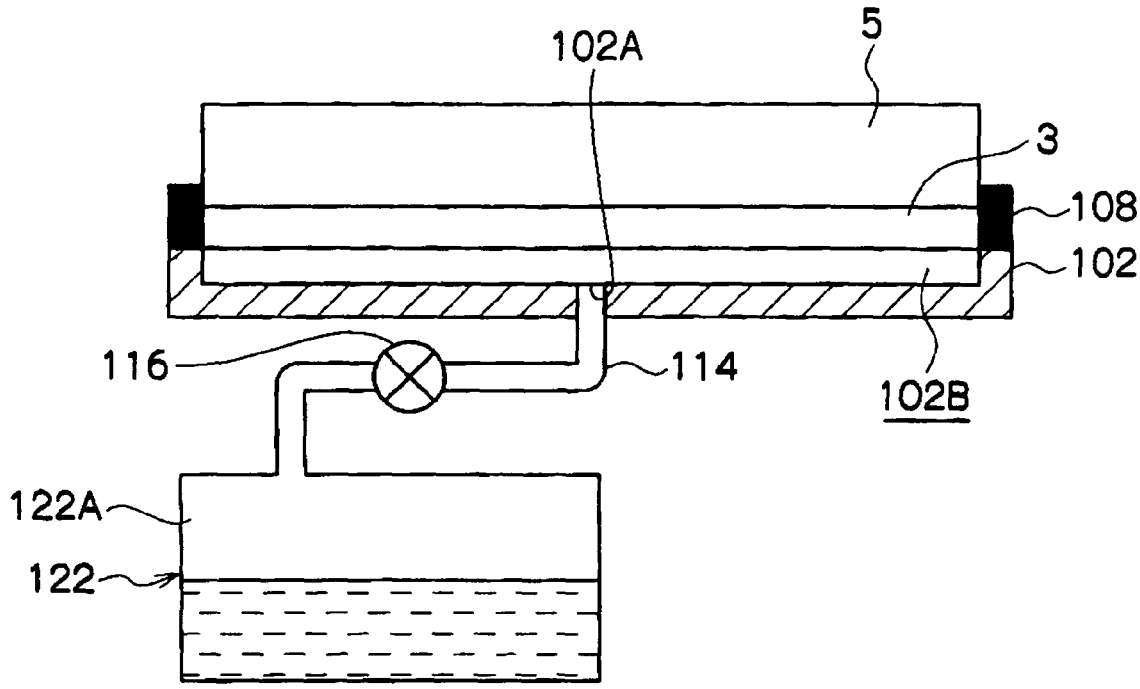
FIG. 21 is an schematic view showing a unit wherein a cap of the invention and a humidity assisting aqueous solution tank are connected in an ink jet recording apparatus in a twelfth embodiment.

FIG. 21 is a schematic view of a unit of a cap 102 of the invention connecting to a humidity assisting aqueous solution tank.

As shown in FIG. 21, the cap 102 is connected to an upper part of the humidity assisting aqueous solution tank 122 to connect to a closed hollow space 122A through a connecting part (tube) 114, and the tube 114 has a valve 116.

An opening 102A is provided in the center of the cap 102, and a connecting part (tube) 114 is connected to the opening 102A.

The humidity assisting aqueous solution tank 122 and the cap space 102B connect to each other through the valve 116, and by making use of the solvent in the humidity assisting aqueous solution tank 122, the humidity of the cap space 102B can be adjusted by opening and closing the valve 116. Since the cap space 102B and humidity assisting aqueous solution tank 122 connect to each other, the inside of the cap space 102B can be stabilized in high humidity state by supply of moisture from the humidity assisting aqueous solution tank 122, in addition to the effect of humidity regulation by the humidity regulating material.

The valve 116 may be opened and closed manually, or automatically by a controller (not shown) to control opening and closing of the valve 116 depending on the result of detection by a humidity sensor (not shown) as a humidity detector that detects humidity in the cap space. That is, the controller controls to open the valve 116 when the humidity in the cap is lower than a specified value, and to close the valve 116 when the humidity becomes higher than a specified value.

A fan (not shown) may be provided for supplying moisture of evaporated solvent in the humidity assisting aqueous solution tank 122 by force. Driving of the fan may be synchronized with the controller for controlling opening and closing of the valve 116, and when the valve 116 is opened, the fan may be driven, and when the valve 116 is closed, the fan may be stopped. Aside from the controller for controlling opening and closing of the valve 116, another controller may be provided for controlling driving of the fan. Or the fan may be driven manually.

In the ink jet recording apparatus of the twelfth embodiment of the invention, since the cap 102 has a humidity regulating material at least in its inner wall as mentioned above, the humidity in the cap space 102B can be regulated without supply of solvent from the humidity assisting aqueous solution tank 122.

Same as the case of the waste ink tank in FIG. 20, a tube may be provided to connect to a valve (not show) and a pump (not shown) by way of a hollow space 122A in the humidity assisting aqueous solution tank 122. By the valve and pump, the cap space 102B closed between the nozzle surface and cap 102 may be evacuated or pressurized to atmospheric pressure.

Other structure of the ink jet recording apparatus of the twelfth embodiment is the same as in the ink jet recording apparatus in the tenth embodiment, and further explanation is omitted.

Recording Apparatus of the Thirteenth Embodiment

In the thirteenth embodiment, a humidifier is provided, and a connecting part 114 is provided for connecting between the humidifier and the cap 102. By making use of the vapor generated from the humidifier, moisture is supplied into the cap space 102B.

The structure of the ink jet recording apparatus in the thirteenth embodiment is the same as in the ink jet recording apparatus in the twelfth embodiment except that the humidity assisting aqueous solution tank 122 is replaced by the humidifier, and further explanation is omitted.

Recording Apparatus of the Fourteenth Embodiment

Figure 22:
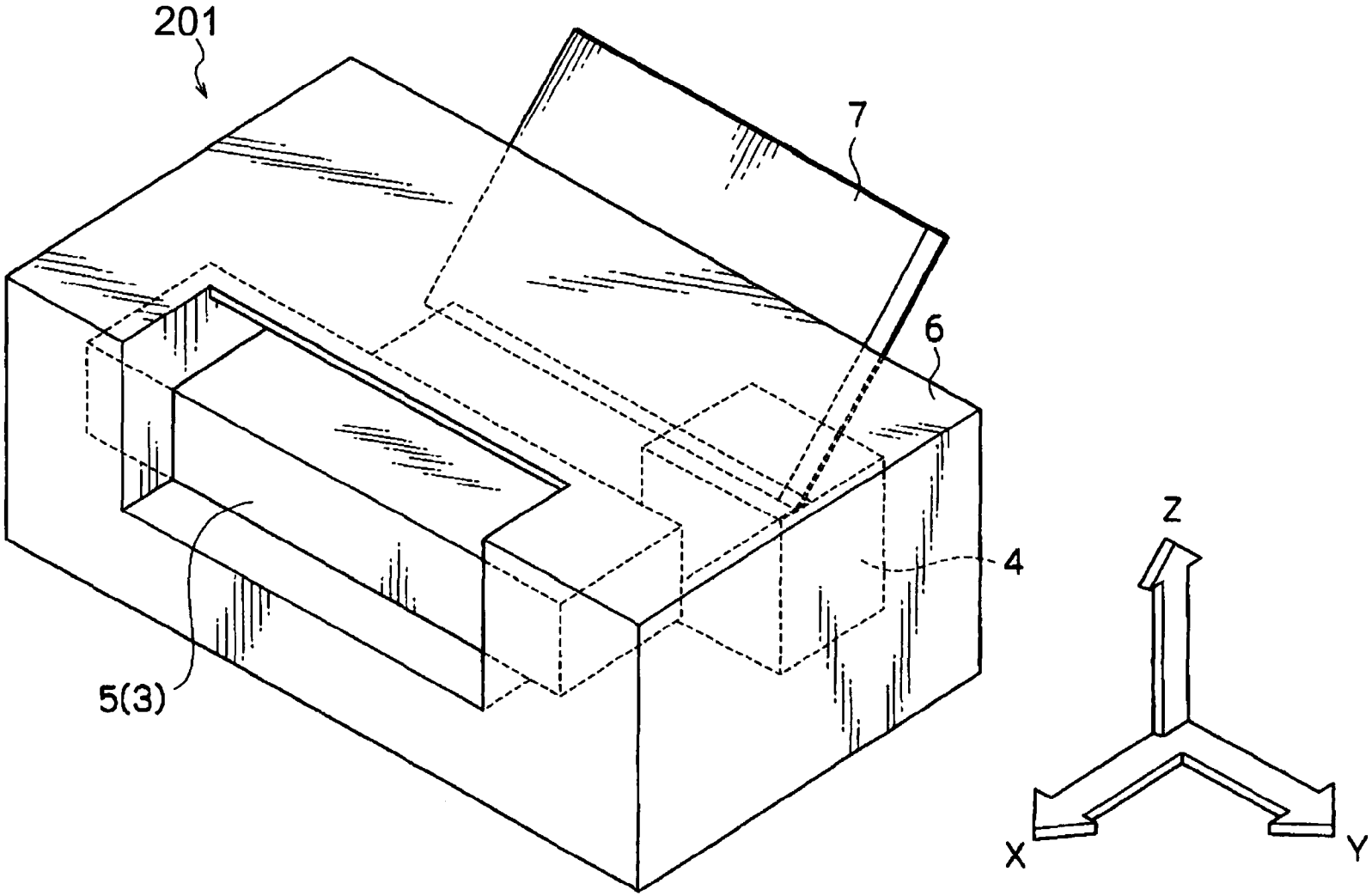
FIG. 22 is a perspective view showing an external appearance of an ink jet recording apparatus in a fourteenth embodiment.
Figure 23:
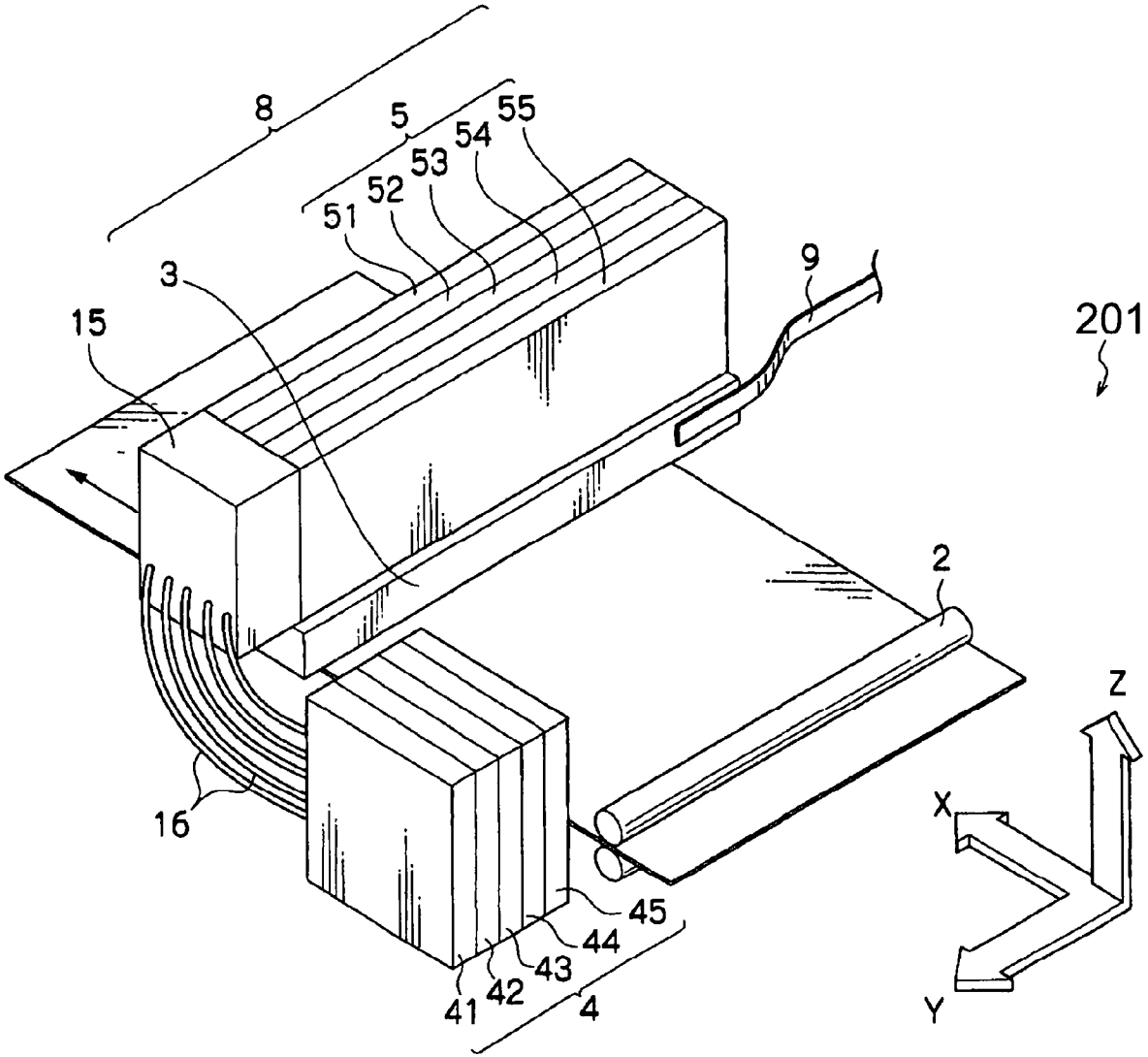
FIG. 23 is a perspective view showing an internal basic configuration of the ink jet recording apparatus in FIG. 22.

FIG. 22 is a perspective view showing an external appearance of an ink jet recording apparatus in the fourteenth embodiment of the invention. FIG. 23 is a perspective view showing an internal basic structure of the ink jet recording apparatus (hereinafter called "recording apparatus") in FIG. 22. The recording apparatus 201 in this embodiment has a structure of forming an image by operating according to the ink jet recording method of the invention described above.

The recording apparatus 201 shown in FIG. 22 and FIG. 23 has the width of the recording head 3 that is the same as or more than the width of the recording medium 1 (Full Width Array, FWA), does not have a carriage mechanism, and includes a paper feed mechanism (a conveying roller 2 is shown in this embodiment, but it may be, for example, a belt type paper feed mechanism) in the sub-scanning direction (conveying direction of the recording medium 1: arrow X direction) (hereinafter an ink jet recording apparatus using an FWA type ink jet recording head (FWA head) may be called FWA type recording apparatus).

Although not shown, ink tanks 51 to 55 are arrayed sequentially in the sub-scanning direction (conveying direction of the recording medium 1: arrow X direction), and similarly nozzle groups for ejecting colors (including a processing liquid) are arranged in the sub-scanning direction. Nozzle rows extend in the main scanning direction.

In the recording apparatus 201 shown in FIG. 22 and FIG. 23, printing in the width direction (main scanning direction) of the recording medium 1 is executed at one time by the recording head 3, and thus the apparatus structure is simple and the printing speed is faster as compared with the apparatus having a carriage mechanism.

Other structure is the same as in the recording apparatus 200 shown in FIG. 17 and FIG. 18, and description thereof is omitted. Although, in the figures, the recording head 3 is not moved and thus the sub ink tank 5 is always connected to the replenishing device 15, the sub ink tank 5 may be connected to the replenishing device 15 only when refilling the ink.

In the ink jet recording apparatus of the fourteenth embodiment, too, while an image is not recorded, that is, while ink is not ejected from the nozzles, the cap 102 is fitted tightly to the recording head 3 by an elevating mechanism not shown. The cap 102 has a structure as mentioned above, having the humidity regulating material at least at a part of its inner wall. The humidity in the cap space 102B is adjusted by the action of the humidity regulating material.

Herein, the cap 102 of the invention may be provided separately from the maintenance unit as in the tenth embodiment, or formed as a part of the maintenance unit as in the eleventh embodiment, or the cap 102 may connect to the waste ink tank 112, so that moisture in the waste ink can be supplied into the cap space 102B.

Further, as in the twelfth embodiment, the humidity assisting aqueous solution tank 122 storing humidity retaining solvent may be provided, and the humidity assisting aqueous solution tank 122 may connect to the cap 102, and moisture may be supplied to the cap space 102B by making use of moisture of the humidity retaining solvent collected in the humidity assisting aqueous solution tank 122.

Or, as in the thirteenth embodiment, a humidifier may be provided, and the humidifier and cap 102 may connect to each other, and moisture may be supplied to the cap space 102B by making of use of vapor generated from the humidifier.

[Forming Apparatus for Forming Resin Product]

The recording apparatus in the first embodiment to fourteenth embodiment is an image forming apparatus (image recording apparatus), in which ink is stored in the sub ink tank 5, and ink is ejected from the nozzles of the recording head 3, and an image is formed on the conveyed recording medium 1. However, the image recording apparatus explained in the first embodiment to fourteenth embodiment may be a forming apparatus for forming a resin product having a desired shape, by filling the sub ink tank 5 with a liquid containing resin, ejecting the liquid containing resin from the nozzles of the recording head 3 according to the given information, and solidifying the ejected resin.

Only the liquid to be contained in the sub ink tank 5 is different, and the structure of the forming apparatus is the same as the ink jet recording apparatus in the first embodiment to fourteenth embodiment, and thus further explanation of the structure of the forming apparatus is omitted.

Such a forming apparatus may be applied in various applications, including a droplet ejecting apparatus used in a direct circuit drawing method of forming a circuit pattern directly on a substrate, droplet ejecting apparatus for manufacturing a color filter, and droplet ejecting apparatus for manufacturing optical members such as a plane emission type light emitting device.

Therefore, the recording medium 1 explained in the first embodiment to fourteenth embodiment is not limited to a recording paper, but may be various recording media such as an intermediate transfer body, glass substrate, and plastic substrate.

The liquid to be contained in the sub ink tank 5 of the forming apparatus contains, for example, a curable optical resin colored in a desired color by a coloring agent for manufacture of the color filter. Examples of the curable optical resin include, for example, an ultraviolet curing type epoxy optical resin, ultraviolet curing type acrylate optical resin, and various thermal curing type optical resins.

For example, for manufacture of an optical member for a plane emission type light emitting device, the optical member is formed by curing a curable liquid material (for example, a precursor of an ultraviolet curing type resin or thermal curing type resin) by applying energy such as heat or light, and thus the sub ink tank 5 stores an ultraviolet curing type acrylic resin and epoxy resin, or a thermal curable resin such as a thermal curing polyimide resin.

Thus, the liquid ejected from the nozzles contains a curable resin, and it is important to prevent nozzle clogging. In the forming apparatus in the first embodiment to fourteenth embodiment, since the humidity can be kept constant near the nozzles, and even when drying, excessive elevation of the viscosity of the liquid containing resin can be prevented, and nozzle clogging can be prevented.

The forming apparatus of the invention can be applied in electric wiring board, color filter, liquid crystal display, organic EL display, and other display device manufacturing fields.

The present invention can provide the following (1) to (12).

(1) A droplet ejecting apparatus including an ejector that ejects a liquid, and a humidity regulator that includes a humidity regulating material and regulates humidity around the ejector.

(2) The droplet ejecting apparatus of (1), wherein the ejector includes a droplet ejecting head having a droplet ejecting surface having a plurality of nozzles for ejecting a liquid, and the humidity regulator includes the humidity regulating material provided on the droplet ejecting surface and regulates the humidity near the nozzles.

(3) The droplet ejecting apparatus of (2), wherein the humidity regulator includes an enclosure member that is disposed at the droplet ejecting surface, has the humidity regulating material provided in an inner wall thereof, and regulates the humidity near the nozzles.

(4) The droplet ejecting apparatus of (1), wherein the ejector includes a droplet ejecting head having a droplet ejecting surface having a plurality of nozzles for ejecting a liquid, and the humidity regulator includes a housing that has the humidity regulating material provided in an inner wall thereof and is disposed so as to accommodate at least the droplet ejecting head.

(5) The droplet ejecting apparatus of (1), wherein the humidity regulator includes the humidity regulating material that is provided in an inner wall of a casing of the droplet ejecting apparatus and regulates the humidity in the droplet ejecting apparatus.

(6) The droplet ejecting apparatus of (1), wherein the humidity regulating material is at least one selected from the group consisting of inorganic porous materials and high molecular humidity regulating materials.

(7) The droplet ejecting apparatus of (1), wherein the humidity regulating material holds or releases moisture depending on the humidity.

(8) The droplet ejecting apparatus of (1), further including a waste ink tank, and a moisture supplying device that is connected to the waste ink tank and supplies moisture to the humidity regulating material.

(9) The droplet ejecting apparatus of (1), further including a humidity assisting aqueous solution tank containing a humidity retaining solvent, and a moisture supplying device that is connected to the humidity assisting aqueous solution tank and supplies moisture to the humidity regulating material.

(10) The droplet ejecting apparatus of (1), further including a humidifier, and a moisture supplying device that is connected to the humidifier and supplies moisture to the humidity regulating material.

(11) The droplet ejecting apparatus of (1), wherein the liquid is ink, and an image is formed by the ejector.

(12) The droplet ejecting apparatus of (1), wherein the liquid is a liquid containing resin, and a resin product is formed by the ejector.

Therefore, according to the invention, liquid characteristics in the ink tank are stable for a long period, so that a droplet ejecting apparatus capable of preventing nozzle clogging can be provided.

The present invention can also provide the following <1>to <9>.

<1> A cap for maintaining a droplet ejecting port in an airtight condition, the droplet ejecting port being for ejecting a droplet by an ink jet system, the cap including, at least in an inner wall, a humidity regulating material containing an inorganic porous material.

In <1>, since an inorganic porous material is used, the cap shape is not deformed. Therefore, according to <1>, if the humidity regulating material has absorbed moisture, the cap can be securely put into a jig, and airtightness can be maintained if moisture has been released from the cap.

Moreover, since the humidity regulating material containing an inorganic porous material absorbs moisture in air, it is not required to install a separate container containing moisture, and it is enough to provide a humidity regulating material containing an inorganic porous material at a part of the cap, so that the cap structure is simple.

<2> The cap of <1>, wherein the average pore radius of the inorganic porous material is approximately 0.5 nm to approximately 40 nm.

According to <2>, owing to the average pore radius of the inorganic porous material in the specific range, the moisture absorbing and releasing capacity of the humidity regulating material, that is, the humidity regulating capacity is enhanced, so that the humidity in the cap can be efficiently regulated.

<3> The cap of <1> or <2>, wherein the inorganic porous material has a humidity regulating film on its surface.

According to <3>, since an inorganic porous material coated with a humidity regulating film on the surface is used, the humidity regulating capacity is enhanced, so that the humidity in the cap can be efficiently regulated.

<4> A droplet ejecting apparatus including an ejector that ejects a droplet by an ink jet system, and the cap of any one of <1> to <3> for maintaining a droplet ejecting port in the ejector in an airtight condition.

According to <4>, since the droplet ejecting apparatus includes the cap of any one of <1> to <3>, nozzle clogging due to drying can be suppressed, and a droplet ejecting apparatus assuring stable ejection performance for a long period can be provided.

<5> The droplet ejecting apparatus of <4>, further including a waste ink tank and a connecting part that connects the waste ink tank and the cap.

According to <5>, since the cap having the humidity regulating material and the waste ink tank connect to each other, moisture in the ink can be supplied into the cap in addition to the effect of humidity regulation by the humidity regulating material, so that the humidity in the cap can be stabilized in higher state.

<6> The droplet ejecting apparatus of <4> or <5>, further including a humidity assisting aqueous solution tank containing a humidity retaining solution, and a connecting part that connects the humidity assisting aqueous solution tank and the cap.

According to <6>, since the cap having the humidity regulating material and the humidity assisting aqueous solution tank connect to each other, solvent (moisture) in the humidity assisting aqueous solution tank can be supplied into the cap in addition to the effect of humidity regulation by the humidity regulating material, so that the humidity in the cap can be stabilized in higher state.

<7> The droplet ejecting apparatus of any one of <4> to <6>, further including a humidifier, and a connecting part that connects the humidifier and the cap.

According to <7>, since the cap having the humidity regulating material and the humidifier connect to each other, moisture from the humidifier can be supplied into the cap in addition to the effect of humidity regulation by the humidity regulating material, so that the humidity in the cap can be stabilized in higher state.

<8> The droplet ejecting apparatus of any one of <4> to <7>, wherein the droplet is ink, and an image is formed by the ejector.

<9> The droplet ejecting apparatus of any one of <4> to <7>, wherein the droplet is a liquid containing resin, and a resin product is formed by the ejector.

Therefore, the invention can provide a cap capable of preventing clogging of a liquid ejecting port due to drying, and a droplet ejecting apparatus having the cap.

What is claimed is:

1. A droplet ejecting apparatus comprising an ejector that ejects a liquid, and a humidity regulator that regulates humidity around the ejector and comprises a humidity regulating material that regulates humidity by absorbing moisture from air until a specific humidity is reached and releases the absorbed moisture when the humidity becomes lower than a specific humidity, the ejector comprising a droplet ejecting head having a droplet ejecting surface having a plurality of nozzles for ejecting a liquid, and the humidity regulator comprising the humidity regulating material being provided on the droplet ejecting surface and regulating the humidity near the nozzles.

2. The droplet ejecting apparatus of claim 1, wherein the humidity regulator comprises an enclosure member that is disposed at the droplet ejecting surface, has the humidity regulating material provided in an inner wall thereof, and regulates the humidity near the nozzles.

3. The droplet ejecting apparatus of claim 1, wherein the humidity regulating material is at least one selected from the group consisting of inorganic porous materials and high molecular humidity regulating materials.

4. The droplet ejecting apparatus of claim 1, wherein the humidity regulating material holds or releases moisture depending on the humidity.

5. The droplet ejecting apparatus of claim 1, further comprising a waste ink tank, and a moisture supplying device that is connected to the waste ink tank and supplies moisture to the humidity regulating material.

6. The droplet ejecting apparatus of claim 1, further comprising a humidity assisting aqueous solution tank containing a humidity retaining solvent, and a moisture supplying device that is connected to the humidity assisting aqueous solution tank and supplies moisture to the humidity regulating material.

7. The droplet ejecting apparatus of claim 1, further comprising a humidifier, and a moisture supplying device that is connected to the humidifier and supplies moisture to the humidity regulating material.

8. The droplet ejecting apparatus of claim 1, wherein the liquid is ink, and an image is formed by the ejector.

9. The droplet ejecting apparatus of claim 1, wherein the liquid is a liquid containing resin, and a resin product is formed by the ejector.

* * * * *